US006855471B2

(12) United States Patent
Katsuta et al.

(10) Patent No.: US 6,855,471 B2
(45) Date of Patent: Feb. 15, 2005

(54) TONER AND IMAGE-FORMING METHOD

(75) Inventors: Yasushi Katsuta, Shizuoka (JP); Manabu Ohno, Shizuoka (JP); Masanori Ito, Tokyo (JP); Emi Tosaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 10/340,717

(22) Filed: Jan. 13, 2003

(65) Prior Publication Data

US 2003/0162116 A1 Aug. 28, 2003

(30) Foreign Application Priority Data

Jan. 15, 2002 (JP) ..... 2002-005541

(51) Int. Cl.[7] ..... G03G 9/093

(52) U.S. Cl. ..... 430/108.23; 430/108.1; 430/108.4

(58) Field of Search ..... 430/108.23, 108.1, 430/108.4

(56) References Cited

U.S. PATENT DOCUMENTS

| | | | | |
|---|---|---|---|---|
| 2,297,691 A | | 10/1942 | Carlson | 95/5 |
| 3,345,293 A | | 10/1967 | Bartoszewicz et al. | 252/62.1 |
| 3,998,747 A | | 12/1976 | Yamakami et al. | 252/62.1 |
| 4,301,355 A | | 11/1981 | Kimbrough et al. | 219/137 PS |
| 4,578,338 A | | 3/1986 | Gruber et al. | 430/120 |
| 4,590,139 A | | 5/1986 | Imai et al. | 430/45 |
| 4,777,105 A | | 10/1988 | Macholdt et al. | 430/109 |
| 4,810,612 A | | 3/1989 | Ueda et al. | 430/109 |
| 4,870,164 A | | 9/1989 | Kühne et al. | 534/742 |
| 4,921,771 A | | 5/1990 | Tomono et al. | 430/110 |
| 4,935,502 A | | 6/1990 | Kühne et al. | 534/742 |
| 4,988,598 A | | 1/1991 | Tomono et al. | 430/99 |
| 4,990,424 A | | 2/1991 | Van Dusen et al. | 430/106.6 |
| 4,997,739 A | | 3/1991 | Tomono et al. | 430/110 |
| 5,004,666 A | | 4/1991 | Tomono et al. | 430/110 |
| 5,023,158 A | | 6/1991 | Tomono et al. | 430/99 |
| 5,629,118 A | | 5/1997 | Tomono et al. | 430/99 |
| 5,629,123 A | | 5/1997 | Tomono et al. | 430/110 |
| 5,707,769 A | | 1/1998 | Hagi et al. | 430/106 |
| 5,800,957 A | * | 9/1998 | Agata et al. | 430/108.24 |
| 6,028,178 A | | 2/2000 | Metz et al. | 534/581 |
| 6,168,895 B1 | | 1/2001 | Metz et al. | 430/106 |

FOREIGN PATENT DOCUMENTS

| | | |
|---|---|---|
| JP | 42-23910 | 11/1967 |
| JP | 43-24748 | 10/1968 |
| JP | 49-46951 | 12/1974 |
| JP | 50-62442 | 5/1975 |
| JP | 52-3304 | 1/1977 |
| JP | 52-3305 | 1/1977 |
| JP | 53-68234 | 6/1978 |
| JP | 55-26574 | 2/1980 |
| JP | 55-42383 | 3/1980 |
| JP | 57-52574 | 3/1982 |

(List continued on next page.)

OTHER PUBLICATIONS

Brandrup, et al., "The Glass Transition Temperatures of Polymers", Polymer Handbook, 2nd Ed., pp. 111–139—111–192 (1971).

*Primary Examiner*—Mark A. Chapman
(74) *Attorney, Agent, or Firm*—Fitzpatrick, Cella, Harper & Scinto

(57) ABSTRACT

A toner contains at least a binder resin, a colorant, a compound (A) and a compound (B) in which the compound (A) is selected from the specific compound group and the compound (B) is a derivative of any one of the compounds included in the group from which the compound (A) is selected. The total content A of the compound (A) and compound (B) in the toner is from 0.2% to 6% by weight based on the weight of the toner, and where the content of the cross-linking agent component in the binder resin is represented by B % by weight based on the weight of the toner, the following relationship is satisfied: $0.1 \leqq A/B \leqq 70$.

25 Claims, 5 Drawing Sheets

FOREIGN PATENT DOCUMENTS

| | | |
|---|---|---|
| JP | 59-57256 | 4/1984 |
| JP | 60-217366 | 10/1985 |
| JP | 60-252360 | 12/1985 |
| JP | 60-252361 | 12/1985 |
| JP | 61-94062 | 5/1986 |
| JP | 61-138259 | 6/1986 |
| JP | 61-273554 | 12/1986 |
| JP | 62-14166 | 1/1987 |
| JP | 62-291669 | 12/1987 |
| JP | 64-22477 | 1/1989 |
| JP | 1-109359 | 4/1989 |
| JP | 2-13968 | 1/1990 |
| JP | 2-79860 | 3/1990 |
| JP | 2-87160 | 3/1990 |
| JP | 2-173760 | 7/1990 |
| JP | 2-37949 | 8/1990 |
| JP | 2-207273 | 8/1990 |
| JP | 2-207274 | 8/1990 |
| JP | 2-208662 | 8/1990 |
| JP | 2-210459 | 8/1990 |
| JP | 3-28789 | 2/1991 |
| JP | 3-50559 | 3/1991 |
| JP | 4-65596 | 3/1992 |
| JP | 4-147152 | 5/1992 |
| JP | 5-100465 | 4/1993 |
| JP | 5-333595 | 12/1993 |
| JP | 6-35221 | 2/1994 |
| JP | 6-230607 | 8/1994 |
| JP | 6-266163 | 9/1994 |
| JP | 7-82254 | 9/1995 |
| JP | 8-36275 | 2/1996 |
| JP | 8-209017 | 8/1996 |
| JP | 8-262799 | 10/1996 |
| JP | 11-52625 | 2/1999 |
| JP | 11-272014 | 10/1999 |
| JP | 2000-109189 | 4/2000 |

* cited by examiner

TONER AND IMAGE-FORMING METHOD

BACKGROUND OF THE INVENTION

1. Field of the Invention

This invention relates to a toner and an image-forming method which are used in electrophotography, electrostatic recording, magnetic recording and toner jetting.

2. Related Background Art

A number of methods as disclosed in U.S. Pat. No. 2,297,691, Japanese Patent Publication Nos. 42-23910 and 43-24748 and so forth are known as methods for electrophotography. In general, fixed images are are obtained by forming an electrostatic latent image on a photosensitive member by various means utilizing a photoconductive material, subsequently developing the latent image by the use of a toner, and transferring the toner image to a transfer material such as paper as the occasion demands, followed by fixing by the action of heat, pressure, heat-and-pressure, or solvent vapor. Also, where the method has the step of transferring the toner image, a step for removing transfer residual toner remaining on the photosensitive member is usually provided, and the above steps are repeated.

Especially in full-color image formation, electrostatic latent images are developed by the use of a magenta toner, a cyan toner, a yellow toner and a black toner, and toner images of the respective colors are superimposed to reproduce multi-color images.

In recent years, the field of utilizing image-forming apparatus making use of such electrophotography is making rapid progress not only in copying machines for merely taking copies of originals, but also in printers used as output means of computers, in personal copying machines for private use and further in plain-paper fax machines, and there are increasing demands in variety. In respect of copying machines, too, they are on the way to higher function by digitization. In particular, on the part of image-forming apparatus, they are being remarkably made smaller in size, higher in speed and more adaptable to color image formation, and further being demanded for higher reliability and higher resolution. For example, those having had a resolution of 200 to 300 dpi (dot per inch) at the beginning are being replaced by those having a resolution of 400 to 1,200 dpi, and further 2,400 dpi.

To meet such demands, image-forming apparatus have come to be designed with simpler components by using members which are highly functional in various respects. As the result, the functionality required for toners has also come to be of a higher order. Thus, under existing circumstances, the improvement in performance of toners must be achieved before any superior image-forming apparatus can be materialized.

For example, in recent years, as transfer assemblies with which toner images on electrostatic latent image bearing members or intermediate transfer members are electrostatically transferred to transfer materials, a case is increasing in which, from the viewpoint of making image-forming apparatus small-sized or preventing ozone from being generated, a contact transfer assembly for performing what is called contact transfer is used. In this transfer assembly, a roller-shaped transfer member to which a voltage is kept applied from the outside is brought into contact with an electrostatic latent image bearing member or intermediate transfer member via the transfer material.

For such a contact transfer assembly, it is preferable for toner particles to be made spherical, from the viewpoint of transfer performance or achievement of high resistance to any mechanical stress coming from the assembly. However, it has turned out that toner particles having a high sphericity have a small specific surface area so as to make a colorant stand poorly dispersed in the interiors of toner particles to greatly affect their transfer performance or matching for the transfer assembly.

Meanwhile, in fixing assemblies for fixing toner images, a heat fixing means on a heat roller system is commonly used which makes use of a pressure roller serving as a rotary heating member and a pressure roller serving as a rotary pressure member (hereinafter called together a fixing roller). Where images are formed at a higher speed, such a fixing roller requires a large quantity of heat energy instantaneously while applying a high pressure. This causes an undesirable situation that the fixing assembly must be made large-sized or its pre-heating time must be set longer. From these viewpoints, it is preferable for toners used in the above image-forming apparatus to exert high sharp-melt performance when heated. Also, such toners not only have a superior fixing performance but also have superior mixing properties when full-color images are formed, and hence have made it possible to broaden the range of color reproduction of the fixed image to be obtained.

However, such toners having good sharp-melt performance commonly have so high affinity for the fixing roller as to tend to cause an offset phenomenon that the toner transfers to the fixing-roller surface at the time of fixing.

This offset phenomenon tends to occur when the fixing temperature is too high or too low. Too high fixing temperature makes the toner have too low viscosity, and hence a toner layer tends to transfer to the fixing-roller surface. Too low fixing temperature makes the toner melt insufficiently, so that the toner can not melt into the transfer material surface to tend to transfer to the fixing-roller surface.

Toners have a temperature range within which favorable fixing can be performed. In actual image formation, however, the temperature of fixing-roller surface may greatly change depending on the environmental temperature when used or the use condition of, e.g., continuous printing on a large number of sheets. Hence, in order to be adaptable to various conditions, it is more preferable for toners to have a broader fixable temperature range.

Even in the case of toners capable of fixing well in a low-temperature region, where the toner layer has come thick on the transfer material, faulty fixing called "image peeling" of about 2 mm in diameter may also occur over several spots on the fixed-image surface, on the side of a low-temperature region. This phenomenon may remarkably occur especially when a color image formed by superimposing a plurality of toners selected from a yellow toner, a magenta toner, a cyan toner and a black toner is formed on the transfer material.

Meanwhile, for the purpose of making the toner not adhere to the fixing-roller surface, for example, a material having good releasability to toners, such as a silicone rubber or a fluorine resin, is used in the surface material of the fixing roller and in addition the fixing-roller surface is covered with a thin film of an offset-preventive liquid in order to prevent the offset phenomenon from occurring and the fixing-roller surface from deteriorating.

The above method is very effective in respect of the prevention of the offset phenomenon. However, difficulties may arise such that (1) since a unit for feeding the offset-preventive liquid is required, the fixing assembly may become complicated to provide a factor of obstruction in designing compact and inexpensive image-forming apparatus; (2) the offset-preventive liquid applied may be permeated into the fixing roller at the time of heating to trigger any peeling at the interface of layers and consequently shorten the lifetime of the fixing roller; (3) since the offset-preventive liquid adheres to the fixed image obtained, a feeling of stickiness may be given and, especially when transparency films utilized in overhead projectors as a means for presentation are used as transfer materials, their transparency may be damaged so that the desired color reproduction cannot be achieved; and (4) the offset-preventive liquid may contaminate the inside of the image-forming apparatus.

In the meantime, transfer materials used in the above image-forming apparatus have also been diversified. For example, as types of paper used as transfer materials, it is the existing condition that not only their basis weights differ but also the materials and contents of raw materials and fillers differ. Some of these transfer materials are composed of materials which are easily desorbed, or tend to adhere to any constituent members of the fixing assembly. Thus, the quality of transfer materials is various. The influence of such transfer materials on fixing assemblies is so great as to make it difficult to make them compact or long-lifetime.

A problem has also arisen such that any contaminants coming from transfer materials and the toner are made into lumps to stick fast to the fixing-roller surface to cause a lowering of the performance of the fixing assembly, or that the matter having stuck may be released to damage the quality of fixed images.

Stated specifically, regenerated paper making use of regenerated pulp obtained by deinking paper once used has come to be in wide use from the viewpoint of environmental conservation. However, the regenerated paper often contains various adultalants or impurities. For example, Japanese Patent Application Laid-Open Nos. 3-28789, 4-65596, 4-147152, 5-100465 and 6-35221 disclose techniques relating to regenerated paper. As disclosed therein, the content and constitution of the adultalants or impurities in the regenerated paper must be specified in order to make it usable in the above image-forming apparatus.

At present, in regenerated paper used in usual office work and so forth, the mixing proportion of regenerated pulp made from newspaper waste paper and so forth is more than 70%. It is predicted that its mixing proportion increases more and more in future, and it is apprehensive that this may cause the above problems. In addition, where a cleaning member for removing toner and so forth having adhered to the surface of the heating roller or a separation member for preventing transfer materials from winding around the roller is provided, it has been ascertained that the surface of the fixing roller may be scratched or abraded or the function of the cleaning member or separation member may greatly lower, because of mechanical-paper type pulp fibers contained in paper dust desorped from, in particular, regenerated paper made from mechanical waste paper such as newspaper and magazine waste paper. Such a phenomenon tends to cause a serious question when using a fixing assembly in which the offset-preventive liquid is applied on the fixing roller in a small quantity or a fixing assembly in which any offset-preventive liquid is not applied.

As stated above, the application of the offset-preventive liquid on the fixing-roller surface of the fixing assembly is very useful, but on the other hand has various problems.

Taking account of the demand made recently on image-forming apparatus, such as miniaturization and weight reduction, and the quality of fixed images, it is preferable to remove even such an auxiliary unit for applying the offset-preventive liquid.

Under such circumstances, it is essential to make technical development relating to the heat-and-pressure fixing of toners, and some measures therefor have been proposed.

Conventionally, from the idea that the offset-preventive liquid should be fed from the interiors of toner particles at the time of heating, without use of any unit for feeding the offset-preventive liquid, methods of incorporating a wax component such as low-molecular-weight polyethylene or polypropylene in toner particles have been proposed in a large number. However, such a wax component must be added to the interiors of toner particles in a large quantity in order to bring out a sufficient effect. In that case, filming on the photosensitive member or contamination of carrier surface or developer-carrying member surface may occur to cause new problems such as image deterioration. Also, where the wax component is added in a small quantity, it turns necessary to juxtapose a unit for feeding the offset-preventive liquid in some quantity or an auxiliary cleaning member such as a wind-up type cleaning web or a cleaning pad. When transparency films are used as transfer materials especially in forming full-color images, the fixed images may have poor transparency or haze because of high crystallization of the wax component or difference in refractive index from binder resins. This problem has remained unsolved.

Japanese Patent Publication Nos. 52-3304 and 52-3305, Japanese Patent Application Laid-Open Nos. 57-52574, 60-217366, 60-252360, 60-252361, 61-94062, 61-138259, 61-273554, 62-14166, 1-109359, 2-79860 and 3-50559 also disclose techniques of incorporating wax in toner particles. If, however, the wax is merely incorporated in toner particles, it is difficult to highly improve various properties required for toners, and the matching for image-forming apparatus making use of the heat-and-pressure fixing system can not be satisfactory.

Meanwhile, there is also an attempt to improve fixing performance by improving a binder included in the toner. For example, a toner is proposed in which a rosin and a rosin derivative which have originally been used in toners as pigment-dispersing agents are added for the purpose of improving fixing performance.

Japanese Patent Application Laid-Open No. 2-173760 and Japanese Patent Publication No. 7-82254 disclose that a polymer having a rosin compound as a condensation component is used as a binder resin. The rosin and the rosin derivative present in toner particles can improve fixing performance to a certain extent. However, in the case of using the fixing assembly in which the offset-preventive liquid is applied in a small quantity or the fixing assembly in which any offset-preventive liquid is not applied, there is room for improvement.

Japanese Patent Applications Laid-Open Nos. 5-333595 and 2000-109189 also disclose that the quantity of a cross-linking agent to be added is controlled to improve fixing performance, but do not mention any rosin compound and its combination with any rosin compound derivative.

Now, in the present technical field, it is known to use various pigments or dyes as colorants for the purpose of improving the color reproducibility of color toner images.

Magenta toners are important in order to use them together with yellow toners to reproduce red color, to which humans have a high visual sensitivity, and required to have good developing performance when, e.g., the flesh color of portraits having a complicated color tone is reproduced. Also, when used together with cyan toners, the second color reproduction of blue color used highly frequently as business color must be achieved.

Conventionally, as the magenta toner, it is known to use any of quinacridone colorants, thioindigo colorants, xanthene colorants, monoazo colorants, perylene colorants and diketopyrrolopyrole colorants alone or in the form of a mixture. For example, Japanese Patent Publication No. 49-46951 discloses a toner making use of a 2,9-dimethylquinacridone pigment; Japanese Patent Application Laid-Open No. 55-26574, a thioindigo pigment; Japanese Patent Application Laid-Open No. 59-57256, a xanthene pigment; Japanese Patent Application Laid-Open No. 11-272014, a monoazo pigment; Japanese Patent Application Laid-Open No. 2-210459, a diketopyrrolopyrole pigment; and Japanese Patent Application Laid-Open No. 55-42383, an anthraquinone pigment.

However, it is not the case that these colorants fulfill all the conditions required for magenta toners. There has been room for improvement in respect of any of toners' color tone, light-fastness and charging performance and also their matching for image-forming apparatus.

It has also been necessary to take into account such a problem that any good negative chargeability can not be achieved because of charge characteristics of colorants used and hence the toner may scatter from the developing assembly to adhere to, and contaminate, the inside of the image-forming apparatus.

Japanese Patent Application Laid-Open No. 1-22477 discloses a method in which a quinacridone organic pigment and a xanthene dye are used in combination and Japanese Patent Application Laid-Open No. 2-13968 discloses a method in which a quinacridone colorant and a methine colorant are used in combination, both to obtain a toner of sharp magenta color and improve the charging performance and light-fastness of the toner and further to prevent the fixing roller such as a silicone rubber roller from being dyed. Japanese Patent Application Laid-Open No. 62-291669 (corresponding to U.S. Pat. No. 4,777,105) further discloses a toner making use of a quinacridone pigment which is in a state of mixed crystals.

Japanese Patent Application Laid-Open No. 11-52625 also discloses a method in which a red pigment classified as a sort of C.I. Pigment Red 48 and a red pigment such as quinacridone pigment having a b* value of −5 or less in the L*a*b* color system are used in combination in a mixing ratio of from 2 to 30% by weight to obtain a toner of good magenta color, improve charging performance and light-fastness of the toner and further improve its heat resistance to the fixing roller.

Meanwhile, many agents are known as colorants for yellow toners. For example, Japanese Patent Application Laid-Open No. 2-207273 discloses dyes such as C.I. Solvent Yellow 112; Japanese Patent Application Laid-Open No. 2-207274, C.I. Solvent Yellow 160; and Japanese Patent Application Laid-Open No. 8-36275, C.I. Solvent Yellow 162. Japanese Patent Application Laid-Open No. 50-62442 further discloses a benzidine yellow pigment; Japanese Patent Application Laid-Open No. 2-87160, a monoazo yellow toner; and Japanese Patent Application Laid-Open No. 2-208662, pigments such as C.I. Pigment Yellow 120, 151, 154 and 156.

The above yellow dyes commonly have superior transparency, but have inferior light-fastness, and may cause not only a problem on storage stability of images but also a problem on the combination with image-forming apparatus.

On the other hand, the above yellow pigments commonly have superior light-fastness as compared with the yellow dyes, but have room for improvement in respect of the state of dispersion in toner particles, and hence have a problem that image fog due to poor charging performance may occur.

Yellow pigments having superior light-fastness or heat resistance may also commonly make toners have so extremely low transparency that OHT (overhead projector transparency film) projected images tend to have a dullness.

Japanese Patent Publication No. 2-37949 discloses a disazo compound having superior light-fastness and its production method. This belongs to a group of compounds typified by C.I. Pigment Yellow 180, and has superior light-fastness and heat resistance.

As other examples in which C.I. Pigment Yellow 180 is used, they may include those disclosed in Japanese Patent Application Laid-Open Nos. 6-230607, 6-266163 and 8-262799. The toners making use of the above pigments, however, can by no means be said to have good transparency, and have not been designed also taking account of fixing performance. Thus, they must further be improved as yellow toners for full-color image formation.

Japanese Patent Application Laid-Open No. 8-209017 discloses a toner for electrophotography in which, in order to solve the above problems, a yellow pigment obtained by making a yellow pigment into fine particles to improve its specific surface area is used to improve transparency and coloring powder. However, making fine the pigment classified as C.I. Pigment Yellow 180 may inevitably result in a great lowering of negative chargeability of the pigment itself. Toners making use of such a pigment have caused a new problem of lack of charge quantity, in particular, lack of charge quantity in an environment of high temperature and high humidity.

The above colorant is also so strongly self-agglomerative that it may disperse with difficulty in a good state in the binder resin included in the toner. Hence, there has been a tendency of showing inferior OHT transparency.

In addition, as a result of studies made by the present inventors on fixing performance of toners containing the colorants mentioned above, it has been found that a tendency of narrowing the fixable-temperature range is seen or image peeling tends to occur. In respect of the toners containing the colorants listed above, their influence on fixing performance is little taken into account. In particular, nothing is taken into account at all on the case in which regenerated paper making use of regenerated pulp in a mixing percentage of more than 70% is used as the transfer material, on the occasion of color image formation where a plurality of toner layers formed on the transfer material must be fixed at a time, on the case in which the fixing assembly in which the offset-preventive liquid is applied on the fixing roller in a small quantity or the fixing assembly in which any offset-preventive liquid is not applied is used, or on how to adapt them to the contact development system.

As having been discussed above, there has not yet been any sufficient measure to generally deal with the system designing of image-forming apparatus making use of the heat-and-pressure fixing system, taking even the developing system into account including colorants used in toners.

In particular, under the eristing circumstances, the above magenta toner and yellow toner, inclusive of their secondary colors, have not yet reached any sufficient level in respect of the transparency and so forth.

SUMMARY OF THE INVENTION

An object of the present invention is to provide a toner having solved such problems that the related background art has had, and an image-forming method making use of such a toner.

More specifically, an object of the present invention is to provide a toner having superior fixing performance over fixing temperatures of from a low-temperature region to a high-temperature region and having sufficiently broad latitude for the fixing temperature, and an image-forming method making use of such a toner.

Another object of the present invention is to provide a toner which does not cause any image peeling even in a low-temperature region, and an image-forming method making use of such a toner.

Still another object of the present invention is to provide a toner having good OHT transparency, and an image-forming method making use of such a toner.

A further object of the present invention is to provide a toner which can promise good image density and fog control, having been made adaptable to an image-forming method having a developing step such that a toner layer formed of a toner held on the surface of a toner-carrying member is brought into contact with the surface of an image-bearing member to develop an electrostatic latent image and a fixing step making use of a heat-and-pressure fixing means in which an offset-preventive liquid is applied in a small quantity; and an image-forming method making use of such a toner.

To achieve the above objects, the present invention provides a toner which contains at least i) a binder resin containing a cross-linking agent component, ii) a colorant, iii) a compound (A) and iv) a compound (B);

the compound (A) being a compound selected from the group consisting of abietic acid, dehydroabietic acid, dihydroabietic acid, neoabietic acid, pimaric acid, isopimaric acid, levopimaric acid, pulstric acid, sandaracopimaric acid, secodehydroabietic acid and agathic acid; the compound (B) being a derivative of the compound included in the group from which the compound (A) is selected; and the total content A (% by weight: based on the weight of the toner) of the compound (A) and compound (B) in the toner being from 0.2% by weight to 6% by weight, and, where the content of the cross-linking agent component in the binder resin is represented by B (% by weight: based on the weight of the toner), satisfying the relationship of:

$$0.1 \leqq A/B \leqq 70.$$

The present invention also provides an image-forming method having at least (a) a charging step of charging electrostatically an image-bearing member for holding thereon an electrostatic latent image; (b) an exposure step of forming by exposure the electrostatic latent image on the image-bearing member thus charged; (c) a developing step of developing the electrostatic latent image by means of a toner held on the surface of a toner-carrying member, to form a toner image; (d) a transfer step of transferring the toner image formed on the surface of the image-bearing member, to a transfer material via, or not via, an intermediate transfer member; and (e) a fixing step of fixing the toner image transferred onto the transfer material, to the transfer material by a heating and pressing means;

the toner being a toner which contains at least i) a binder resin containing a cross-linking agent component, ii) a colorant, iii) a compound (A) and iv) a compound (B);

the compound (A) being a compound selected from the group consisting of abietic acid, dehydroabietic acid, dihydroabietic acid, neoabietic acid, pimaric acid, isopimaric acid, levopimaric acid, pulstric acid, sandaracopimaric acid, secodehydroabietic acid and agathic acid; the compound (B) being a derivative of the compound included in the group from which the compound (A) is selected; and the total content A (% by weight: based on the weight of the toner) of the compound (A) and compound (B) in the toner being from 0.2% by weight to 6% by weight, and, where the content of the cross-linking agent component in the binder resin is represented by B (% by weight: based on the weight of the toner), satisfying the relationship of:

$$0.1 \leqq A/B \leqq 70.$$

DESCRIPTION OF THE PREFERRED EMBODIMENTS

Figure 1:
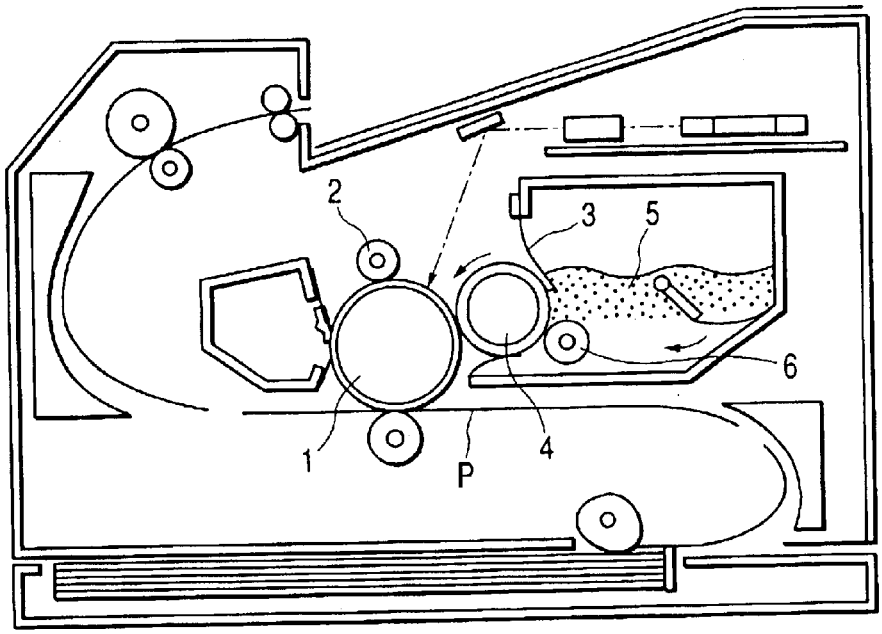
FIG. 1 is a schematic illustration of an image-forming apparatus used in Examples of the present invention.

As a result of extensive studies, the present inventors have specified in a toner the total content of a compound (A) (including abietic acid, dehydroabietic acid, dihydroabietic acid, neoabietic acid, pimaric acid, isopimaric acid, levopimaric acid, pulstric acid, sandaracopimaric acid, secodehydroabietic acid and agathic acid) and a compound (B) which is a derivative of any one of the compounds from which the compound (A) is selected, and also specified the content of a cross-linking agent, thereby accomplishing the invention of a toner having very good fixing performance and having a superior matching for image-forming apparatus.

Constitutional characteristic features of the toner and materials therefor are described first.

The compound (A) contained in the toner of the present invention is a compound selected from the group consisting of abietic acid, dehydroabietic acid, dihydroabietic acid, neoabietic acid, pimaric acid, isopimaric acid, levopimaric acid, pulstric acid, sandaracopimaric acid, secodehydroabietic acid and agathic acid. Any of these compounds may be used alone or may be used in combination of two or more.

The compound (B) is a salt or ester of the compound included in the group from which the compound (A) is selected, i.e., the group consisting of abietic acid, dehydroabietic acid, dihydroabietic acid, neoabietic acid, pimaric acid, isopimaric acid, levopimaric acid, pulstric acid, sandaracopimaric acid, secodehydroabietic acid and agathic acid. As the compound (B), it may be used alone or may be used in combination of two or more. In the case of a salt, the salt may preferably be a salt with any of $K^+$, $Na^+$, $Ca^{2+}$, $Ba^{2+}$, $Al^{3+}$ and $NH_4^+$, and particularly preferably $Ca^{2+}$. Also, in the compound (A) and compound (B), their chief skeletons may be different from each other.

The toner of the present invention contains a binder resin containing a cross-linking agent component, and contains a colorant, the compound (A) and the compound (B), and the total content A of the compound (A) and compound (B) in the toner is from 0.2% by weight to 6% by weight based on the weight of the toner, and, where the content of the cross-linking agent component in the binder resin is represented by B (% by weight based on the weight of the toner), the following relationship is satisfied: $0.1 \leqq A/B \leqq 70$, and preferably $1 \leqq A/B \leqq 50$.

Satisfying the above relationship makes the toner have good fixing performance and also enable improvement in image density and image fog.

The reason why such an effect is brought about is not necessarily clear. The present inventors consider that since the compound (A) and compound (B) have cyclic structure and carboxylic groups, they act as plasticizers when incorporated in the toner in a stated quantity, and make the toner have good fixing performance and good anti-offset properties. Stated specifically, the toner can have good fixing performance in both the low-temperature region and the high-temperature region, and hence it can have a broad latitude for fixing temperature and can well deal with any changes in fixing temperature which may be caused during continuous printing on many sheets.

In addition, the total content A (% by weight: based on the weight of the toner) of the compound (A) and compound (B) in the toner is from 0.2% by weight to 6% by weight, preferably from 0.2% by weight to 4% by weight, and more preferably from 0.2% by weight to 3% by weight.

If the value of A is less than 0.2% by weight, the compound (A) and compound (B) may not serve as plasticizers to tend to cause image peeling. If the value of A is more than 6% by weight, the toner may have a low chargeability because of carboxyl groups in the molecules, so that image density may lower or image fog may occur when printed on many sheets.

It is essential in the toner of the present invention that a binder resin cross-linked with a cross-linking agent component is present in the toner. Where the total content of the compound (A) and compound (B) in the toner is represented by A (% by weight: based on the weight of the toner) and the content of the cross-linking agent component in the binder resin is represented by B (% by weight: based on the weight of the toner), the toner of the present invention satisfies $0.1 \leqq A/B \leqq 70$, preferably $1 \leqq A/B \leqq 50$, and more preferably $2 \leqq A/B \leqq 30$. This makes the toner have good fixing performance in both the low-temperature region and the high-temperature region.

If the value of A/B is less than 0.1, the cross-linking agent component may be present in a predominant quantity, and hence the toner may become hard to cause a lowering of fixing performance in the low-temperature region. If on the other hand the value of A/B is more than 70, the compound (A) and compound (B) may serve as plasticizers so strongly as to tend to cause a lowering of fixing performance in the high-temperature region.

As a method of determining the quantity of the cross-linking agent component contained in the binder resin used in the present invention, a conventionally known measuring method may be used. As a specific example, it may be determined by preparing a calibration curve of the cross-linking agent component, using a pyrolysis gas chromatograph mass spectrometer.

In the toner of the present invention, where the content of the compound (A) is represented by X (% by weight: based on the weight of the toner) and the content of the compound (B) by Y (% by weight: based on the weight of the toner), their content may further be so controlled as to satisfy the relationship of $0.25 \leqq X/Y \leqq 9$, and preferably $2 \leqq X/Y \leqq 7$. This can improve the dispersibility of colorant in toner particles, and can improve OHT transparency.

As will be detailed later, the compound (A) and the compound (B) may be introduced into toner particles as agents for treating the colorant. In that case, the content of the compound (A) and compound (B) present at colorant particle surfaces and the value of their presence ratio X/Y may be determined by the following measuring method.

The compound (A) is soluble in tetrahydrofuran (THF) and acetone and the compound (B), having the structure of a salt, is soluble in THF but insoluble in acetone. Utilizing this solubility, the THF-soluble matter and acetone-soluble matter in a pigment may be determined. Stated specifically, the pigment is weighed in an amount of 0.5 g to 1.0 g (W1 g), which is then put in a cylindrical filter paper (e.g., No. 86R, available from Toyo Roshi K.K.) and set on a Soxhlet extractor. Extraction is carried out for 20 hours using 200 ml of THF as a solvent, and the soluble component extracted with THF is evaporated, followed by vacuum drying at 100° C. for 24 hours. Then the THF-soluble component is weighed (W2 g). The THF-insoluble matter (% by weight) is calculated from $100 \times (W2/W1)$. The proportion thus found is the proportion of the total content of the compound (A) and compound (B) in the pigment. Also, in respect to the THF-soluble matter, the same procedure as the above may be repeated but using acetone as a solvent, to determine the proportion of the content of the compound (A). This proportion may be subtracted from the proportion of the total to determine the proportion of the content of the compound (B). The proportion and contents of the compound (A) and compound (B) may be controlled by controlling the throughput of the both components in respect of the pigment.

Where the compound (B) is an ester compound, the THF-soluble matter may be extracted by the same method as the above, and the THF-soluble matter may be subjected to gel permeation chromatography or liquid chromatography. From its calibration curve, the content of each of the compound (A) and compound (B) may be determined.

As a method of finding the value of A from the toner, the toner may be dissolved in a solvent such as THF, and the soluble matter may be subjected to gel permeation chromatography, gas chromatography or liquid chromatography. The value may be calculated from the calibration curve. In Examples given later, a sample was weighed in an amount of 0.5 g to 1.0 g, which was then put in a cylindrical filter paper (e.g., No. 86R, available from Toyo Roshi K.K.) and set on a Soxhlet extractor. Extraction was carried out for 20 hours using from 100 ml to 200 ml of THF as a solvent, and the soluble component extracted with THF was used as a measuring sample to make measurement by gel permeation chromatography (GPC) under the following conditions.

GPC Measurement Conditions

Apparatus: GPC-150 (Waters Co.).

Columns: Combination of eight columns Shodex KF-801, KF-802, KF-803, KF-804, KF-805, KF-806, KF-807 and KF-808 (available from Showa Denko K.K.).

Temperature: 40° C.

Solvent: Tetrahydrofuran (THF).

Flow rate: 1.0 ml/min.

Sample: 0.1 ml of a 0.5 to 5 mg/ml sample is injected.

The content A may be measured under the above conditions. In calculating the molecular weight of the sample, a molecular-weight calibration curve prepared using a monodisperse polystyrene standard sample may be used.

The value of Y may also be found in the following way. The soluble component extracted with THF is evaporated, followed by vacuum drying at 100° C. for few hours to obtain a THF-soluble resin. The THF-soluble resin thus obtained is thoroughly washed with acetone to obtain an acetone-insoluble matter. The acetone-insoluble matter obtained is again dissolved in THF, followed by gel permeation chromatography, gas chromatography or liquid chromatography. The value may be calculated from the calibration curve.

The specific compounds included in the compound (A) used in the present invention are listed below, in the order of, from the top, dehydroabietic acid, abietic acid, dihydroabietic acid, neoabietic acid, pimaric acid, isopimaric acid, levopimaric acid, pulstric acid, sandaracopimaric acid, secodehydroabietic acid and agathic acid.

(1)

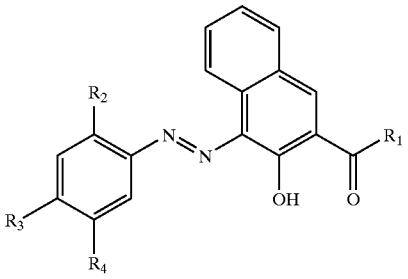

(2)

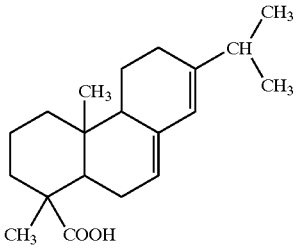

(3)

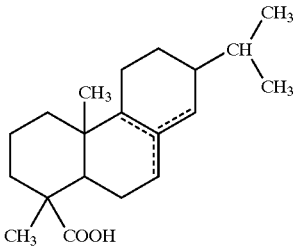

(4)

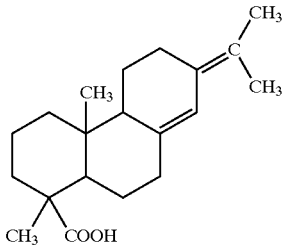

-continued (5)

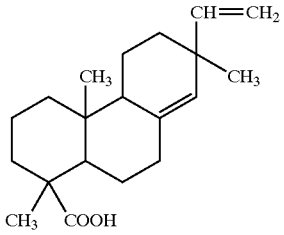

(6)

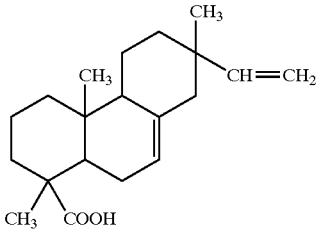

(7)

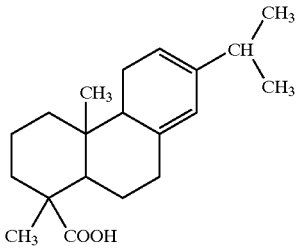

(8)

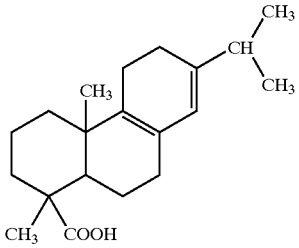

(9)

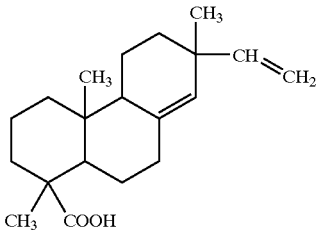

(10)

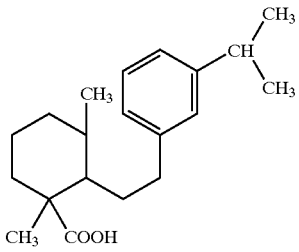

-continued (11)

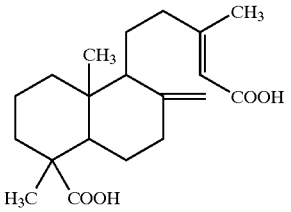

The binder resin used in the present invention is one having been cross-linked with a cross-linking agent, and may be any of those utilizing the cross-linking effect attributable to hydrogen bonding or the van der Waals force and those utilizing the cross-linking effect attributable to covalent bonding. As the cross-linking agent component, a resin making use of a polyfunctional polymerizable vinyl monomer is preferred. The polyfunctional polymerizable monomer may include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy.diethoxy)phenyl] propane, trimethyrolpropane triacrylate, tetramethyrolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy.diethoxy)phenyl]propane, 2,2'-bis [4-(methacryloxy.polyethoxy)phenyl]propane, trimethyrolpropane trimethacrylate, tetramethyrolmethane tetramethacrylate, divinylbenzene, divinyl naphthalene, and divinyl ether.

In the toner of the present invention, it is particularly preferable to use divinylbenzene as the cross-linking agent component. In this case, the plasticization effect attributable to the compound (A) and compound (B) as described above and the curing effect attributable to the cross-linking agent component are well balanced, and the fixing performance is more improved. As the divinylbenzene used in the present invention, any of ortho-, meta- and para-products may be used, or a mixture of any of these may also be used.

As a magenta colorant used when the toner of the present invention is prepared as a magenta toner, from the viewpoint of chroma, light-fastness, transparency, developing performance and fixing performance, it may preferably be a pigment composition represented by the following structural formula.

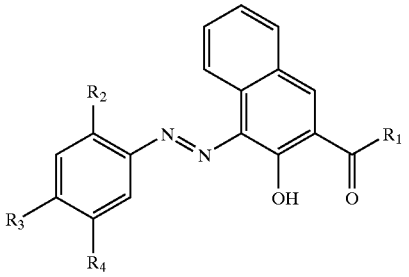

wherein $R_1$ is selected from —OH, —$NH_2$,

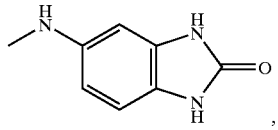

,

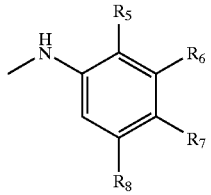

(wherein $R_5$ to $R_8$ are each independently a hydrogen atom or a substituent selected from a halogen atom, an alkyl group, an alkoxyl group and a nitro group); and $R_2$ to $R_4$ are each independently a hydrogen atom or a substituent selected from a halogen atom, an alkyl group, an alkoxyl group, a nitro group, an anilido group and a sulfamoyl group.

Of the pigment composition represented by the above structural formula, the magenta colorant may particularly preferably be selected from the group consisting of C.I. Pigment Red 5, C.I. Pigment Red 31, C.I. Pigment Red 146, C.I. Pigment Red 147, C.I. Pigment Red 150, C.I. Pigment Red 184 and C.I. Pigment Red 269 (each according to what is named in Color Index, Fourth Edition).

The above pigment composition may be used alone, or, if necessary, may be used in combination with other colorant. As the colorant which may be used in combination, a conventionally known colorant may be used in combination, which may include, e.g., quinacridone colorants, thioindigo colorants, xanthene colorants, perylene colorants and diketopyrrolopyrole colorants.

As a yellow colorant used when the toner of the present invention is prepared as a yellow toner, it may preferably be selected from the group consisting of C.I. Pigment Yellow 17, C.I. Pigment Yellow 74, C.I. Pigment Yellow 93, C.I. Pigment Yellow 155 and C.I. Pigment Yellow 180 (each according to what is named in Color Index, Fourth Edition), any of which may be used alone or in combination of two or more.

As a cyan colorant used when the toner of the present invention is prepared as a cyan toner, usable are copper phthalocyanine compounds and derivatives thereof, anthraquinone compounds and basic-dye lake compounds. Stated specifically, C.I. Pigment Blue 1, 7, 15, 15:1, 15:2, 15:3, 15:4, 60, 62 and 66 (each according to what is named in Color Index, Fourth Edition) may particularly preferably be used.

As a black colorant used when the toner of the present invention is prepared as a black toner, carbon black and a magnetic material may preferably be used. From the viewpoint of coloring power, carbon black used preferably in the present invention may preferably be one having a BET specific surface area of from 20 to 300 $m^2/g$ and a DBP oil absorption of from 30 to 200 ml/100 g. Those having been toned in black using the above yellow, magenta and cyan colorants may also be used.

In the present invention, the binder resin described above may be used in combination with a resin having a polarity (hereinafter "polar resin") such as polyester resin, polycarbonate resin or a vinyl polymer having a polar group. The addition of a polar resin in the toner makes it easy to keep the compound (A) or compound (B) in the toner from localizing at the toner particle surfaces, and control any influence on the charging performance of the toner.

For example, where the toner is directly produced by suspension polymerization described later, such a polar resin may be added during polymerization reaction of from a dispersion step to a polymerization step, thus, the formation of toner particles can be so controlled that the polar resin added forms thin layers on the surfaces of toner particles or becomes present in the toner particles with gradation from their surfaces to cores, in accordance with the balance of the polarity shown by a toner-particle-forming polymerizable monomer composition and an aqueous dispersion medium. In particular, the compound (A) and compound (B) can effectively be prevented from localizing at the toner particle surfaces when a polar resin having an acid value of from 1 to 20 mg.KOH/g is used.

The polar resin may preferably be added in an amount of from 1 to 25 parts by weight, and more preferably from 2 to 15 parts by weight, based on 100 parts by weight of the binder resin. Its addition in an amount less than 1 part by weight may make non-uniform the state of presence of the polar resin in the toner. On the other hand, its use in an amount more than 25 parts by weight may make thick the thin layers of polar resin formed on the toner particle surfaces, and hence the fixing performance tends to become poor.

As the polyester resin usable in the present invention, it may preferably have a weight-average molecular weight of from 3,000 to 100,000 in order to obtain an especially good toner. If it has a weight-average molecular weight lower than 3,000, the toner particles may have soft surfaces to cause a lowering of anti-blocking properties in some cases. If on the other hand it has a weight-average molecular weight higher than 100,000, the polyester resin may be hard to dissolve in vinyl monomers and it is difficult to produce toner particles by the suspension polymerization.

As an acid component and an alcohol component included in the polyester resin, the following may be exemplified.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (A) and a diol represented by the following Formula (B).

(A)

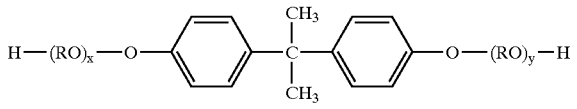

wherein R represents an ethylene group or a propylene group, x and y are each an integer of 1 or more, and an average value of x+y is 2 to 10;

(B)

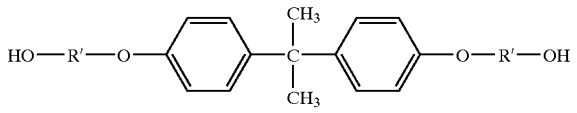

wherein R' represents $—CH_2CH_2—$,

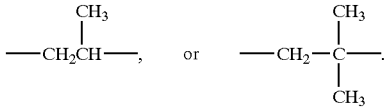

As the acid component, it may include benzene dicarboxylic acids and anhydrides thereof such as phthalic acid, terephthalic acid, isophthalic acid and phthalic anhydride; alkyldicarboxylic acids such as succinic acid, adipic acid, sebacic acid and azelaic acid, and anhydrides thereof; succinic acid having as a substituent an alkyl group or alkenyl group having 6 to 18 carbon atoms, or anhydrides thereof; and unsaturated dicarboxylic acids such as fumaric acid, maleic acid, citraconic acid and itaconic acid, and anhydrides thereof.

Where the polyester resin or polycarbonate resin is used as the polar resin, the toner can also be improved in charging performance, the image fog and spots around line images (toner scattering) can be better prevented, and also high-grade images having superior dot reproducibility can be formed. Also, it is possible to impart an appropriate mechanical strength to the toner particles, so that any influence of toner deterioration ascribable to image-forming apparatus can be confined to the minimum, also bringing about improvements in running performance against printing on many sheets and in the matching for image-forming apparatus detailed later. Moreover, when the toner particles are treated to be spherical or when the toner is directly produced by polymerization, any influence from toner production steps such as drying can be confined to the minimum. Also, the polar resin may be used in a combination of two or more types, and the chargeability inherent in themselves may be utilized.

The use of the polar resin as described above is by no means limited to one type of polymer. For example, two or more types of polyester resins may simultaneously be used, or two or more types of vinyl monomers may be used. Polymers of quite different types may also optionally be added to the binder resin, as exemplified by polymers such as polyester resins having no reactivity, epoxy resins polycarbonate resins, polyolefins, polyvinyl acetate, polyvinyl chloride, polyalkyl vinyl ethers, polyalkyl vinyl ketones, polystyrene, polyacrylate or methacrylate, melamine formaldehyde resin, polyethylene terephthalate, nylons and polyurethane.

In the toner of the present invention, a wax component may also be incorporated. The wax component usable here may specifically include petroleum waxes such as paraffin wax, microcrystalline wax and petrolatum and derivatives thereof, montan wax and derivatives thereof, hydrocarbon waxes obtained by Fischer-Tropsch synthesis and derivatives thereof, polyolefin waxes typified by polyethylene wax and derivatives thereof, and naturally occurring waxes such as carnauba wax and candelilla wax and derivatives thereof. The derivatives include oxides, block copolymers with vinyl monomers, and graft modified products. The wax component may also include alcohols such as higher aliphatic alcohols, fatty acids such as stearic acid and palmitic acid or compounds of these, acid amides, esters, ketones, hardened caster oil and derivatives thereof, vegetable waxes, and animal waxes. Any of these may be used alone or in combination.

Of these, the use of polyolefin waxes, hydrocarbon waxes obtained by Fischer-Tropsch synthesis, petroleum waxes, higher alcohol waxes or higher ester waxes brings about a much higher effect of improving developing performance and transfer performance. To these wax components, an antioxidant may be added as long as it does not affect the charging performance of toner. Also, any of these wax components may preferably be used in an amount of from 1 to 30 parts by weight based on 100 parts by weight of the binder resin.

The wax component used in the present invention may preferably be a compound having an endothermic main peak temperature (melting point) in the range of from 30 to 120° C., and more preferably from 40 to 90° C., in the DSC (differential scanning calorimetry) curve measured according to ASTM D3418-8.

Where the wax component having thermal properties as described above is used, the resulting toner has a good fixing performance as a matter of course, the release effect attributable to the wax component is exhibited in a good efficiency, a sufficient fixing temperature region is ensured, and also any bad influence of conventionally known wax components on developing performance, blocking resistance and image-forming apparatus can be eliminated. In particular, since specific surface area of toner particles decreases as the toner particle shape is made spherical, it is very effective to control the thermal properties and state of dispersion of the wax component.

The endothermic main peak temperature of the wax component is measured using, e.g., a differential scanning calorimeter DSC-7 (manufactured by Perkin-Elmer Corporation). The temperature at the detecting portion of the device is corrected on the basis of melting points of indium and zinc, and the calorie is corrected on the basis of heat of fusion of iridium. In the measurement, a measuring sample is put in a pan made of aluminum and only a pan (empty pan) made of aluminum is set as a control. The endothermic main peak temperature is determined from a DSC curve which is obtained when heated at a heating rate of 10° C./min in the measurement region of from 20° C. to 180° C. Here, when the measurement is made on only the wax component, the temperature is previously raised-and-dropped once under the same conditions as those at the time of measurement, and measurement is started after the previous history has been removed. When the measurement is made on the wax component kept contained in toner particles, the measurement is made in the untouched state without the operation of removing the previous history.

The wax component used in the present invention may also preferably be one having a number-average molecular weight (Mn) of from 200 to 2,000, a weight-average molecular weight (Mw) of from 400 to 3,000, and also Mw/Mn of not more than 3.0. The use of such a wax is preferred. The use of wax components whose number-average molecular weight is less than 200 and weight-average molecular weight is less than 400 is undesirable because the proportion of the low-molecular weight component increases and consequently causes problems on the charging performance of toner and the matching for image-forming apparatus. The use of wax components whose number-average molecular weight is more than 2,000 and weight-average molecular weight is more than 3,000 is also undesirable in view of a lowering of color-mixing performance because it is difficult to make fixed-image surface appropriately smooth. Also, since granulation and polymerization are carried out in an aqueous dispersion medium when the toner particles are obtained by polymerization, the use of such wax components is not preferable because the wax component may become deposited chiefly during granulation.

In the present invention, the molecular-weight distribution of the wax component is measured by GPC (gel permeation chromatography) under such conditions as shown below.

GPC Measurement Conditions

Apparatus: GPC-150C (Waters Co.).

Columns: GMH-HT, a series of two columns (available from Toso Co., Ltd.).

Temperature: 135° C.

Solvent: o-Dichlorobenzene (0.1% ionol-added).

Flow rate: 1.0 ml/min.

Sample: 0.4 ml of a sample of 0.15% in concentration is injected.

Molecular weights are measured under conditions shown above. Molecular weight of the sample is calculated using a molecular-weight calibration curve prepared from a monodisperse polystyrene reference sample, and converted in terms of polyethylene according to a conversion equation derived from the Mark-Houwink viscosity equation.

The binder resin used in the toner of the present invention may include styrene-acrylate or methacrylate copolymers, polyester resins, epoxy resins, and styrene-butadiene copolymers which are commonly used. In the process where the toner particles are directly produced by polymerization, as monomers for forming the binder resin, they may include, e.g., styrene; styrene monomers such as o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile and acrylic acid amide; any of which may preferably be used.

Any of these may be used alone, or commonly used in the form of an appropriate mixture of monomers so mixed that the theoretical glass transition temperature (Tg) as described in a publication POLYMER HANDBOOK, 2nd Edition, III pp. 139–192 (John Wiley & Sons, Inc.) may range from 40° C. to 75° C. If the theoretical glass transition temperature is lower than 40° C., problems may arise in respect of storage stability or running stability of toner. If on the other hand it is higher than 75° C., the fixing point of the toner may become higher.

To the toner of the present invention, a charge control agent may be added. In particular, as the charge control agent used in the present invention, a charge control agent which has a high charging speed and also can maintain a constant charge quantity is preferred. In the case when the toner particles are directly produced by polymerization, it is preferable to use charge control agents having no polymerization inhibitory action and free of matter soluble in the aqueous dispersion medium. As specific compounds, they may include, as negative charge control agents, metal compounds of aromatic carboxylic acids such as salicylic acid, naphthoic acid and dicarboxylic acid, polymer type compounds having sulfonic acid or carboxylic acid in the side chain, boron compounds, urea compounds, silicon compounds, and carixarene. As positive charge control agents, they may include quaternary ammonium salts, polymer type compounds having such a quaternary ammonium salt in the side chain, guanidine compounds, and imidazole compounds.

In the present invention, however, the addition of the charge control agent is not essential. For example, in the case when a two-component developing system is employed, the triboelectric charging with a carrier may be utilized. Also in the case when a non-magnetic one-component blade-coating developing system is employed, the triboelectric charging with a blade member or a sleeve member may be utilized. Accordingly, the charge control agent need not necessarily be contained in the toner particles.

Adding an inorganic fine powder to the toner of the present invention is an embodiment preferable for improvement in developing performance, transfer performance, charging stability, fluidity and running performance. As the inorganic fine powder, any known powder may be used, but may preferably be selected from fine powders of silica, alumina, titania or double oxides thereof. In particular, silica is preferred. The silica includes what is called dry-process silica or fumed silica produced by vapor phase oxidation of silicon halides or alkoxides and what is called wet-process silica produced from alkoxides or water glass, either of which may be used. The dry-process silica is preferred, since silanol groups at the surface and inside are less and production residues such as $Na_2O$ and $SO_3^{2-}$ are less. In the dry-process silica, it is also possible to use, in its production step, other metal halides such as aluminum chloride or titanium chloride together with the silicon halide to obtain a composite fine powder of silica with other metal oxides. The fine silica powder includes these, too.

The inorganic fine powder used in the present invention may preferably have a specific surface area of 30 $m^2/g$ or more, and more preferably in the range of from 50 to 400 $m^2/g$, as measured by nitrogen gas absorption according to the BET method. Such an inorganic fine powder can produce good results, and may be used in an amount of from 0.3 to 8 parts by weight, and preferably from 0.5 to 5 parts by weight, based on 100 parts by weight of the toner particles.

Where the toner particle surfaces are covered with the inorganic fine powder whose BET specific surface area has been controlled as described above, any faulty charging due to colorants present at the toner particle surfaces can be kept from occurring. Also, since an appropriate fluidity is imparted to the toner, the toner can be improved in uniform-charging performance cooperatively, so that the above good effect can be maintained even when printing on many sheets is continuously repeated.

If the inorganic fine powder has a specific surface area of less than 30 $m^2/g$, it is difficult to impart an appropriate fluidity to the toner. If it has a specific surface area of more than 400 $m^2/g$, the inorganic fine powder is embedded in the toner particle surfaces at the time of continuous printing to lower the fluidity of toner in some cases.

To measure the specific surface area, nitrogen gas is adsorbed on sample surfaces using a specific surface area measuring device AUTOSOBE 1 (trade name; manufactured by Yuasa Ionics Co.), and the specific surface area is calculated by the BET multiple-point method.

If the inorganic fine powder is added in an amount of less than 0.3 part by weight based on 100 parts by weight of the toner particles, its addition can not be effective. If on the other hand it is in an amount of more than 8 parts by weight, not only problems may occur on the charging performance and fixing performance of the toner, but also any inorganic fine powder having become liberated may make the matching for image-forming apparatus greatly poor.

If necessary, for the purposes of imparting hydrophobicity and controlling chargeability, the inorganic fine powder used in the present invention may preferably be treated with a treating agent such as silicone varnish, modified silicone varnish of various types, silicone oil, modified silicone oil of various types, a silane coupling agent, a silane coupling agent having a functional group, or other organosilicon compounds or organotitanium compounds, or in combination with various treating agents.

In order to maintain a high charge quantity of the toner and achieve a low consumption and a high transfer efficiency, it is preferred that the inorganic fine powder is treated with at least silicone oil.

In the toner of the present invention, other additives may also be used as developability improvers in a small quantity as long as they substantially do not adversely affect the toner, which may include lubricant powders as exemplified by polyfluoroethylene powder, zinc stearate powder and polyvinylidene fluoride powder; abrasives as exemplified by cerium oxide powder, silicon carbide powder and strontium titanate powder; fluidity-providing agents or anti-caking agents as exemplified by titanium oxide powder and aluminum oxide powder; conductivity-providing agents as exemplified by carbon black powder, zinc oxide powder and tin oxide powder; and reverse-polarity organic particles and inorganic particles.

The toner of the present invention may be used in itself as a one-component developer, or may be used in combination with a carrier as a two-component developer.

When used as the two-component developer, for example, a magnetic carrier blended with the toner may be constituted in the state of ferrite containing at least one element selected from iron, copper, zinc, nickel, cobalt, manganese and chromium. The magnetic carrier may be spherical, flat or amorphous. A magnetic carrier whose particle surface microstructure (e.g., surface unevenness) has appropriately been controlled may also be used. Resin-coated carriers surface-coated with a resin and magnetic-powder disperse type resin carriers may also preferably be used. The carrier used may have an average particle diameter of from 10 to 100 $\mu$m, and more preferably from 20 to 50 $\mu$m. Also, when such a carrier and the toner are blended to prepare the two-component developer, the toner in the developer may preferably be in a concentration of from about 2 to 15% by weight.

A process for producing the toner of the present invention is described below.

Where the toner of the present invention is produced by suspension polymerization, the compound (A) and compound (B) may directly be incorporated in the polymerizable monomer to carry out polymerization. Also, where the toner is produced by pulverization, these compounds may be incorporated in the binder resin and melt-kneaded. As another method, in either case of the suspension polymerization and the pulverization, the compound (A) and compound (B) may be treated into the colorant and incorporated in the toner.

As methods of treating the colorant, they include (1) a dry-process mixing method in which the compound (A), the compound (B) and the colorant are mixed by a dry process and thereafter optionally subjected to heat treatment such as melt kneading, and (2) a wet-process mixing method in which, where the compound (B) is a salt, an aqueous alkali solution of the compound (A) is incorporated in a colorant-synthesizing solution when the colorant is produced, and thereafter a lake metal salt of scalcium, barium, strontium or manganese is added to make the compound (A) insoluble, whereby the colorant particle surfaces are treated and coated with the compound (A) and compound (B). In respect of the method (2), an aqueous alkali solution of the compound (A) may be added to a liquid mixture of the colorant and the lake metal salt.

When the compound (A) and compound (B) are previously treated into the colorant to produce the toner, their presence ratio X/Y in the toner, in the method (2), can be controlled with ease by changing the amount of the lake metal salt to be added.

When the toner of the present invention is produced by suspension polymerization, any known inorganic or organic dispersant may be used as a dispersant to be added to the aqueous dispersion medium. Stated specifically, the inorganic dispersant includes, e.g., tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina. The organic dispersant includes, e.g., polyvinyl alcohol, gelatin, methyl cellulose, methyl hydroxypropyl cellulose, ethyl cellulose, carboxymethyl cellulose sodium salt, and starch.

Commercially available nonionic, anionic or cationic surface active agents may also be used. For example, usable are sodium dodecylsulfate, sodium tetradecylsulfate, sodium pentadecylsulfate, sodium octylsulfate, sodium oleate, sodium laurate, potassium stearate and calcium oleate.

In the process for producing the toner of the present invention, a slightly water-soluble dispersant of an inorganic type is preferred, and besides a slightly water-soluble inorganic dispersant which is soluble in an acid may preferably be used. In the present invention, when the aqueous dispersion medium is prepared using the slightly water-soluble inorganic dispersant, such a dispersant may preferably be used in a proportion of from 0.2 to 2.0 parts by weight based on 100 parts by weight of the polymerizable vinyl monomer. Also, in the present invention, the aqueous dispersion medium may preferably be prepared by using water in an amount of from 300 to 3,000 parts by weight based on 100 parts by weight of the polymerizable monomer composition.

In the present invention, when the aqueous dispersion medium in which the slightly water-soluble inorganic dispersant as described above has been dispersed is prepared, a commercially available dispersant may be used as it is, to make a dispersion. However, in order to obtain dispersant particles having a fine and uniform particle size, such a slightly water-soluble inorganic dispersant may be prepared in a liquid medium such as water under high-speed stirring. For example, when tricalcium phosphate is used as the dispersant, an aqueous sodium phosphate solution and an aqueous calcium chloride solution may be mixed to form fine particles of tricalcium phosphate, thus a preferable dispersant can be obtained.

In the case where the toner of the present invention is produced by suspension polymerization, a polymerization initiator used therein may specifically include azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. The polymerization initiator may usually be used in an amount of from 5 to 20 parts by weight based on 100 parts by weight of the polymerizable vinyl monomer, which varies depending on the intended degree of polymerization. The polymerization initiator may a little differ in type depending on the methods for polymerization, and may be used alone or in the form of a mixture, making reference to its 10-hour half-life period temperature.

In order to control the degree of polymerization, any known cross-linking agent, chain transfer agent and polymerization inhibitor may further be added to the polymerizable monomer composition. These additives may previously be incorporated in the polymerizable monomer composition or may appropriately be added in the course of polymerization reaction as the occasion demands.

The image-forming method of the present invention is described below.

In the image-forming method of the present invention, the "heating and pressing means" is a means for heat-and-pressure fixing the toner image held on the transfer material. The heating and pressing means is a means in which (i) a rotary heating member having at least a heating medium and a rotary pressure member are provided and brought into contact with each other to form a nip, (ii) the offset-preventive liquid to be applied to the surface coming into contact with the toner image held on the transfer material is set at a consumption of 0.025 mg/cm$^2$ or less (based on unit area of the transfer material) and (iii) the toner image held on the transfer material is heated and pressed at the nip.

The "rotary heating member" constituting a part of the heating and pressing means (heat fixing means) is a member for fixing to the transfer material the toner image held thereon. It is, as will be detailed later, (i) a cylindrical member having in its interior a heating medium for providing heat to the toner image; which is used in a heating and pressing means on a heat roller system; (ii) a cylindrical, heat-resistant endless-film member having in its interior a heating medium for providing heat to the toner image, fastened to and supported on a support, and movable in pressure contact with the heating medium; which is used in a heating and pressing means on a film system; (iii) a cylindrical, heat-resistant endless-film member having in its interior a magnetic-field generation means and having a heating layer for providing heat to the toner image by generating heat by electromagnetic induction by the action of the magnetic-field generation means; which is used in a heating and pressing means on an electromagnetic-induction system; or the like.

The "rotary pressure member" is a member kept in contact with the rotary heating member to form a nip, and heating and pressing the toner image held on the transfer material while holding and transporting the transfer material at and through the nip.

In the image-forming method of the present invention, the offset-preventive liquid applied to the surface coming into contact with the toner image held on the transfer material is set at a consumption of 0.025 mg/cm$^2$ or less (based on unit area of the transfer material), and may preferably be set in the state that the offset-preventive liquid is not applied at all. This can prevent the problems caused by the offset-preventive liquid as stated previously, and also the use of the toner of the present invention makes it possible to maintain the performance of such a heating and pressing means over a long period of time and provide superior fixed images.

The consumption of the offset-preventive liquid is measured using regenerated paper for usual office work (mixing percentage of regenerated pulp: 70% or more) adapted to the maximum paper feed region of the heating and pressing means on which the consumption is to be measured, and is defined to be the value (mg/cm$^2$) found when the weight (mg) of the offset-preventive liquid consumed by feeding 100 sheets of regenerated paper is divided by the total area ($cm^2$) of the regenerated paper used.

As the offset-preventive liquid according to the present invention, used is one capable of standing liquid at from −15° C. to almost 300° C. and having superior releasability. Stated specifically, it may include dimethylsilicone oil, modified silicone oils some methyl groups of which has been replaced with other substituent(s), mixtures of these, and those to which a surface-active agent has been added in a small quantity. One having a viscosity of from 100 to 10,000 $mm^2/s$ (cSt) may preferably be used.

The above offset-preventive liquid may be applied on the fixing roller by any conventionally known method, including a method in which the liquid is allowed to soak in a coating felt, a felt pad, a felt roller, a web, a Poreflon rod or the like and then applied, and a method in which the liquid is directly applied by means of a draw-up roller or the like.

Preferred heating and pressing means used in the image-forming method of the present invention are described below with reference to the accompanying drawings.

Figure 2:
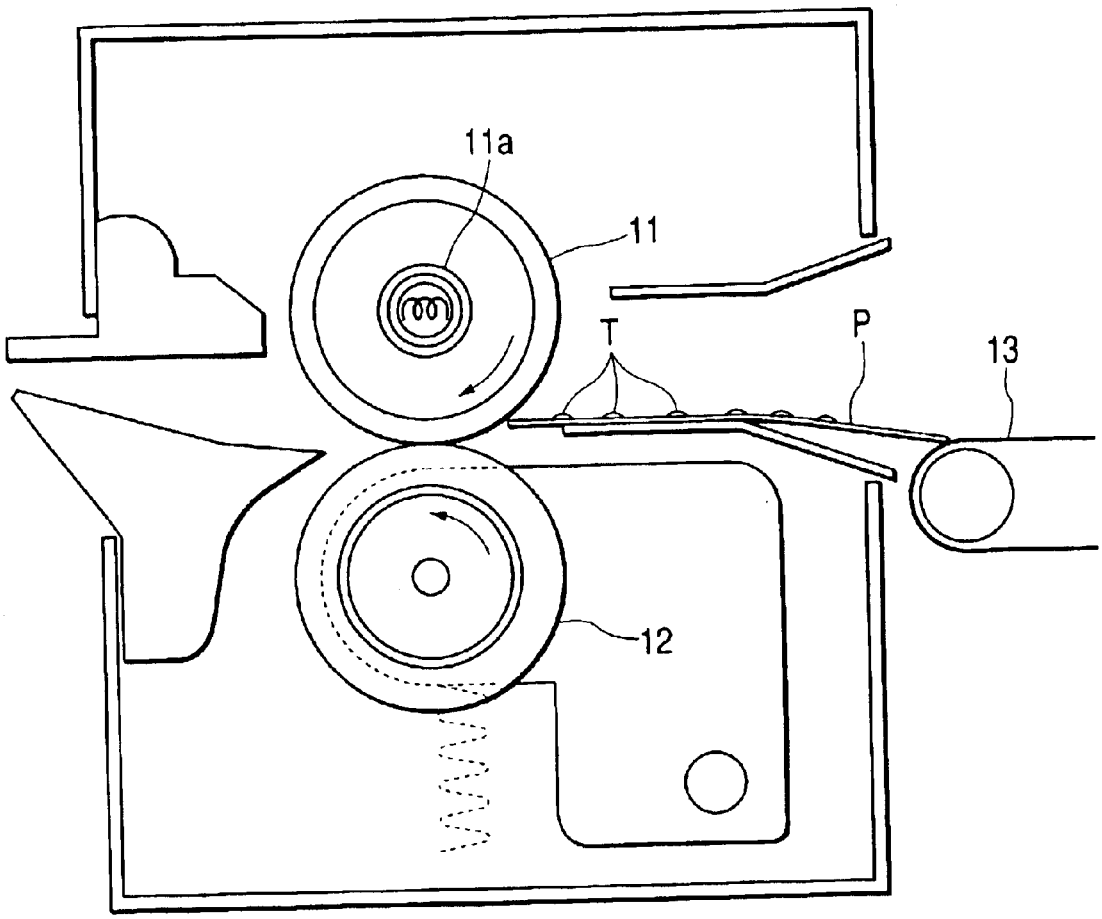
FIG. 2 is a schematic illustration of a heating and pressing means on a heat roller system, used in Examples of the present invention.

FIG. 2 is a schematic illustration of an example of the heating and pressing means on a heat roller system, which has as the rotary heating member a cylindrical heating roller having in its interior a heating medium and is not provided with any cleaning member for removing fixing-residual toner and any separation member for preventing transfer materials from winding around it.

A rotary heating member formed of a cylindrical heating roller 11 having in its interior a heating medium such as a heater 11*a* and a cylindrical pressure roller 12 serving as the rotary pressure member are kept in pressure contact to form a nip between them, and are each rotated in the direction of an arrow when driven.

A transfer material P as a material to be heated which holds thereon an unfixed toner T as a toner image is transported by a transport belt 13 from the right side as viewed in the drawing (i.e., the upstream side). A fixed image is formed on the transfer material P by heating and pressing the toner image while holding and transporting the transfer material P at and through the nip, and is then delivered to the left side as viewed in the drawing (i.e., the downstream side).

Figure 3A:
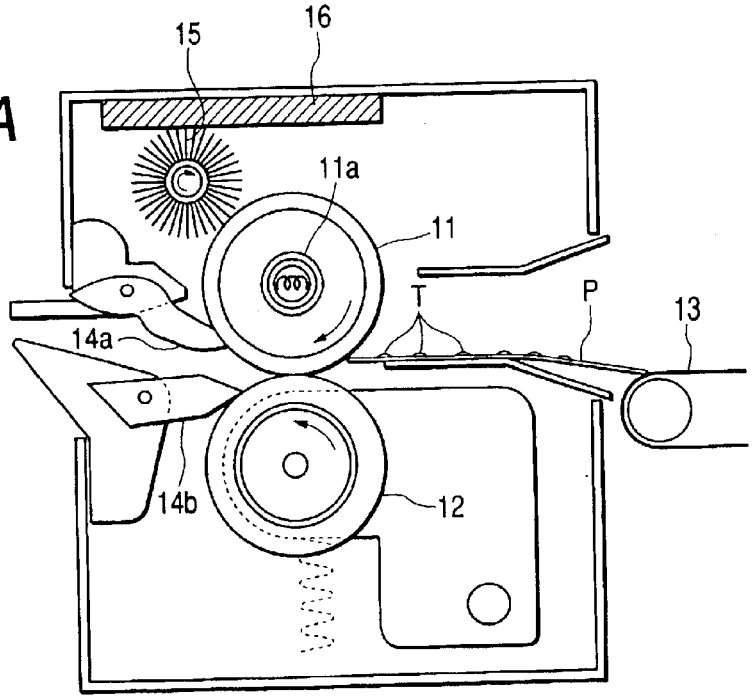
FIGS. 3A and 3B are schematic illustrations of heating and pressing means on a heat roller system, having separation claws, in which one is provided with a brush-like cleaning roller (FIG. 3A) and the other is provided with a cleaning roller impregnated with an offset-preventive liquid (FIG. 3B).
Figure 3B:
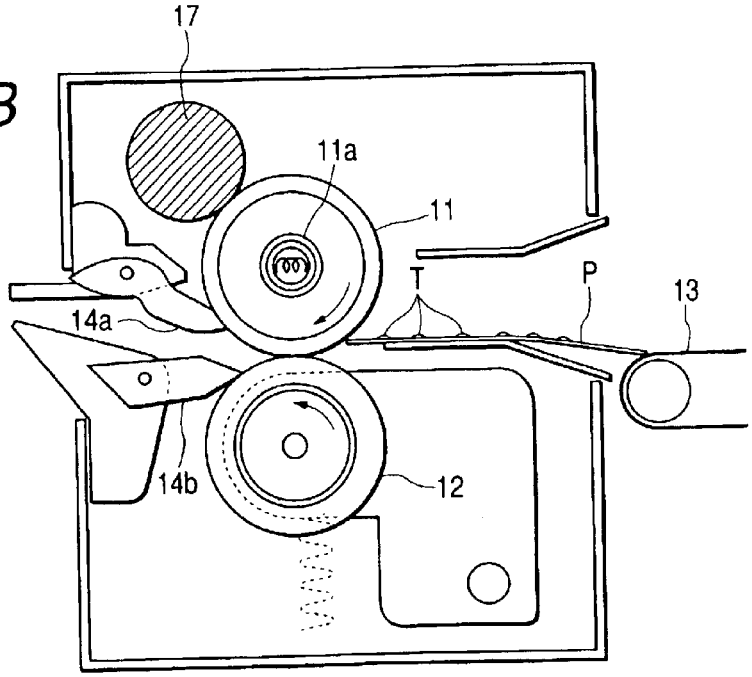

In the heating and pressing means according to this embodiment, it also does not have any separation claw 14*a* or 14*b*, as shown in FIGS. 3A and 3B, for separating the transfer material P from the heating roller 11 or pressure roller 12.

Where as shown in FIG. 3A the heating and pressing means is further provided with a cleaning roller 15 and a felt-like oil pad 16 and also where as shown in FIG. 3A it is provided with a cleaning roller 17, the heating and pressing means is so set that the consumption of the offset-preventive liquid to the transfer material is 0 to 0.025 $mg/cm^2$; the cleaning roller 15 being formed by setting brush-like fibers in the form of a cylinder, in order to apply the offset-preventive liquid while removing the fixing-residual toner remaining on the surface of the heating roller 11; the oil pad 16 having been impregnated with the offset-preventive liquid; and the cleaning roller 17 having been impregnated with the offset-preventive liquid.

Conventionally, the offset-preventive liquid has also the function of surface protection of the heating roller 11 or pressure roller 12. Hence, where the offset-preventive liquid is set at a consumption within the above range, it is applied in so small quantity as to tend to cause scratching or abrasion of the surface of the heating roller 11 or pressure roller 12 as a result of long-term service and also bring about a lowering of releasability due to such scratching or abrasion. Any heating and pressing means being in such a state tends to cause such a phenomenon that the transfer material winds around the heating roller or pressure roller 12. The phenomenon of winding more tends to occur more frequently where the above separation claws are not provided. However, the use of the toner of the present invention lessens the load on the above heating and pressing means and makes it possible to obtain good fixed images over a long period of time.

As the heating roller 11 used in the heating and pressing means of the present invention, a roller may be used which is formed of, e.g., an aluminum pipe (as a mandrel) of about 2 to 5 mm in wall thickness the peripheral surface of which is coated with a silicone rubber or fluorine rubber in a thickness of 200 to 500 $\mu$m.

As the pressure roller 12, a roller may also be used which is formed of, e.g., a stainless-steel (SUS) pipe (as a mandrel) of about 10 mm in diameter the peripheral surface of which is covered with a silicone rubber in a thickness of about 3 mm.

As the heater 11*a* provided in the interior of the heating roller 11, a tubular heater such as a halogen lamp is used, which generates heat upon application of a stated voltage, and the heating roller 11 is heated by its radiation heat. When thus heated, the heating roller 11 and the pressure roller 12 kept in pressure contact with the former are relatively slowly heated on. However, since they have commonly a large heat capacity, they are heated over a long time in many cases, so that the heating roller 11 and the pressure roller 12 tend to undergo deterioration by heat. Especially where the regenerated paper is used or the offset-preventive liquid is applied in a small quantity, the heating roller 11 or the pressure roller 12 tends to be scratched or abraded. Hence, the deterioration by heat may be accelerated and problems of a lowering of the releasability of the roller surface may arise. However, the use of the toner of the present invention lessens the load on the above heating and pressing means and makes it possible to obtain good fixed images over a long period of time.

Figure 4A:
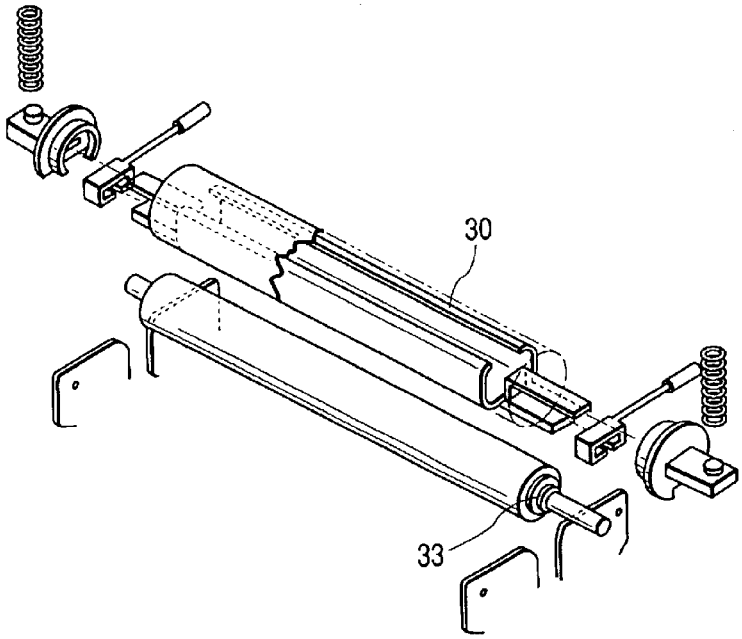
FIGS. 4A and 4B illustrate a main-part exploded perspective (FIG. 4A) and its enlarged transverse cross section (FIG. 4B), of a heating and pressing means on a film system, used in Examples of the present invention.
Figure 4B:
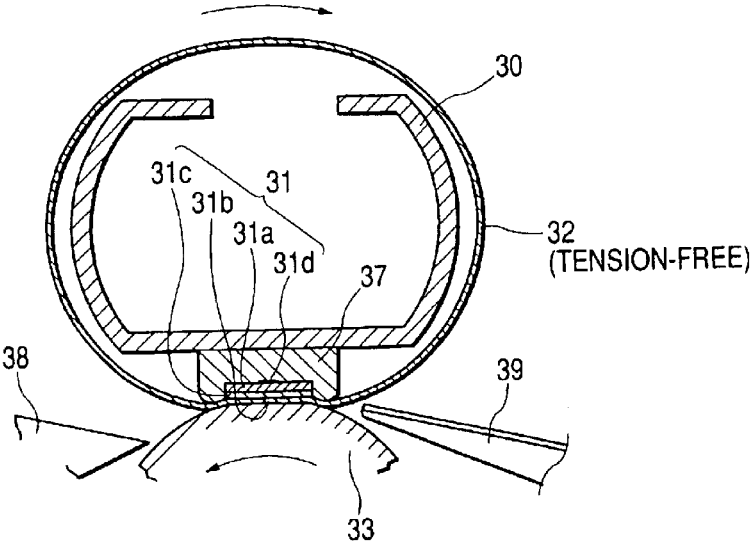

FIG. 4A is an exploded perspective view of an example of the heating and pressing means on a film system, which has as the rotary heating member a cylindrical heat-resistant endless film having in its interior a heating medium fastened to and supported on a support, and moving in pressure contact with the heating medium, and heats and presses the toner image via the endless film. FIG. 4B is an enlarged transverse cross section of the main part of the above heating and pressing means.

A rotary heating member formed of a cylindrical heat-resistant endless film 32 having in its interior a heating medium 31 fastened to and supported on a support 37 and a cylindrical pressure roller 33 serving as a rotary pressure member via the heat-resistant endless film 32 are kept in mutual pressure contact to form a nip between them. At the same time, they are each rotated in the direction of an arrow at the time of drive, and bring the transfer material as a material to be heated, holding thereon the toner image, into close contact with the heat-resistant endless film 32 to press it against the heating medium 31 via the film, and move it together with the heat-resistant endless film 32.

The heating medium 31, which is a low heat capacitance linear heating medium, fastened to and supported on the support 37 consists of a heater substrate 31*a*, an electrification heat-generating resistor (heating element) 31*b*, a surface protective layer 31*c* and a temperature detector 31*d*. As the heater substrate 31*a*, a member having heat resistance, insulation properties, low heat capacitance and high thermal conductivity is preferred, as exemplified by an alumina substrate of 1 mm in thickness, 10 mm in width and 240 mm in length.

The heating element 31*b* is an element formed by applying, e.g., an electrically resistant material such as Ag—Pd (silver-palladium), $Ta_2N$ or $RuO_2$ in a linear or thin-belt form of about 10 μm in thickness and 1 to 3 mm in width by screen printing or the like along the long dimension and substantially at the middle of the bottom surface (the side facing the film 32) of the heater substrate 31*a*. Heat-resistant glass is applied thereon in a thickness of about 10 μm as the surface protective layer 31*c*.

The temperature detector 31*d* is, e.g., a low heat capacitance temperature-measuring resistor such as a Pt film formed by screen printing or the like substantially at the middle of the top surface (the side opposite to the side on which the heating element 31*b* is provided) of the heater substrate 31*a*. In addition, a low heat capacitance thermistor may also be used as a substitute.

The heating medium 31 causes the heating element 31*b* to generate heat substantially over its whole length by electrifying the heating element 31*b* at a given timing in accordance with image formation start signals.

The heating medium 31 is electrified at AC 100 V. Electric power to be supplied is controlled by controlling the phase angle of its electrification by means of an electrification control circuit (not shown) in accordance with the temperature detected by the temperature detector 31*c*.

The heating medium 31 gives a great thermal shock to the heat-resistant endless film 32 or the pressure roller 33 as the rotary pressure member and is made to have releasability, because the heater substrate 31*a*, the heating element 31*b* and the surface protective layer 31*c* have so small heat capacitance that the surface of the heating medium 31 may rapidly be heated to the desired fixing temperature upon electrification to the heating element 31*b* or may rapidly be cooled to about room temperature when not in use. However, the use of the toner of the present invention lessens the load on the above heating and pressing means and makes it possible to obtain good fixed images over a long period of time.

The cylindrical heat-resistant endless film 32 positioned between the rotary heating member and the rotary pressure member may preferably be a heat-resistant sheet constituted of a single layer, or a composite layer, of 20 μm to 100 μm in thickness from the viewpoint of heat resistance, strength security, durability and low heat capacitance. For example, preferred is a single-layer film of polyimide, polyether imide (PEI), polyether sulfone (PES), tetrafluoroethylene-perfluoroalkyl vinyl ether copolymer resin (PFA), polyether ether ketone (PEEK) or polyparabanic acid (PPA), or a composite-layer film of, e.g., a polyimide film having a thickness of 20 μm and provided, in a thickness of 10 μm at least on its side coming into contact with the toner image, with a release coat layer of a fluorine resin such as a tetrafluoroethylene resin (PTFE), PAF or FEP or a silicone resin, to which a conductive material such as carbon black, graphite or conductive whisker has further been added.

The rotary pressure member, pressure roller 33, serves also as a drive roller for moving and driving the above heat-resistant endless film 32. Hence, it may preferably not only have good releasability to the toner and so forth but also ensure its close contact with the heat-resistant endless film 32. Accordingly, for example, a rubber elastic material such as silicone rubber is used. As stated above, the thermal shock applied to the pressure roller 33 is so great that any surface deterioration of the offset-preventive liquid due to long-term service may affect the driving function itself of the above heating and pressing means. However, the use of the toner of the present invention lessens the load on the above heating and pressing means and makes it possible to obtain good fixed images over a long period of time.

Figure 5:
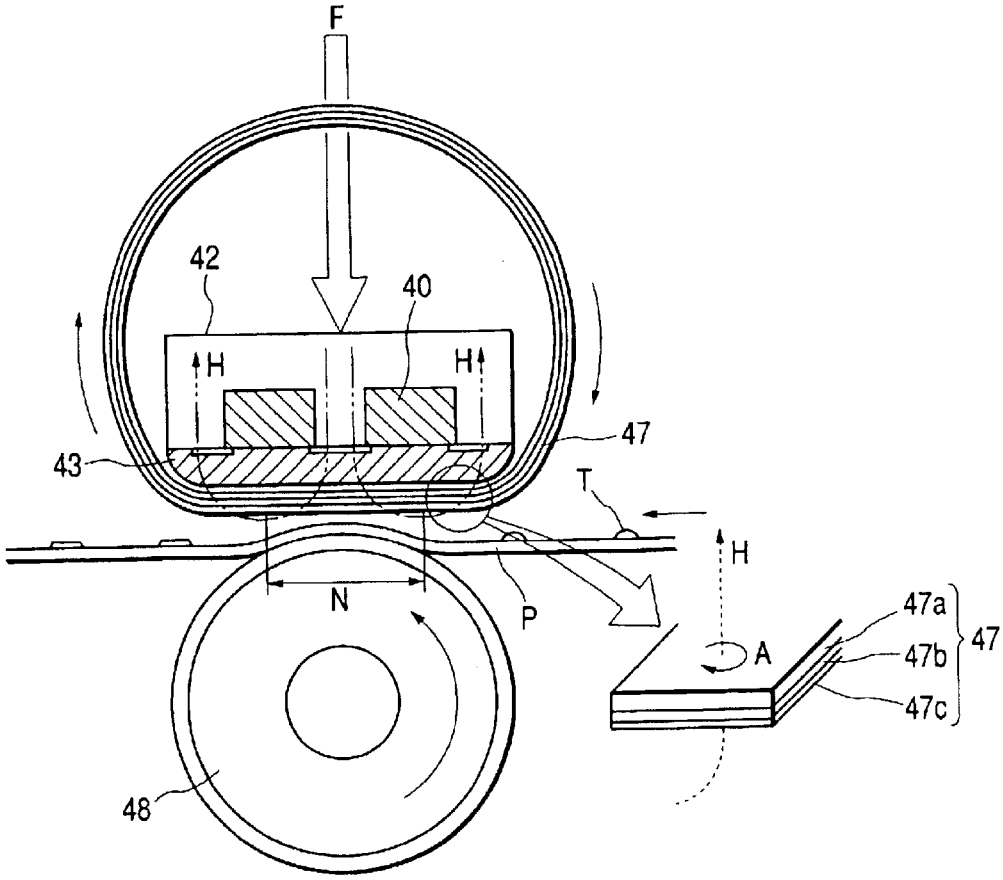
FIG. 5 is a schematic illustration of a heating and pressing means on an electromagnetic-induction system, used in Examples of the present invention.

FIG. 5 is a schematic illustration of an example of a heating and pressing means on an electromagnetic-induction system, which has a rotary heating member formed of a cylindrical heat-resistant endless film having in its interior a magnetic-field generation means and having a heating layer which generates heat by electromagnetic induction by the action of the magnetic-field generation means.

The heating and pressing means has in its interior a magnetic-field generation means consisting of an exciting coil 40, a coil core (a magnetic material) 42 around which the exciting coil 40 is wound, and a sliding plate 43 which guides the traveling of a heat-resistant endless film 47 while supporting the exciting coil 40. A rotary heating member formed of the cylindrical heat-resistant endless film 47, which is moved and driven while coming in contact with the magnetic-field generation means, and a cylindrical pressure roller 48 serving as a rotary pressure member via the heat-resistant endless film 47 are brought into pressure contact with each other to form a nip N between them. At the same time, they are each rotated in the direction of an arrow at the time of drive, and bring a transfer material P as a material to be heated, holding thereon the toner image T, into close contact with the heat-resistant endless film 47 to press the transfer material against the magnetic-field generation means via the film, and move and drive the transfer material together with the heat-resistant endless film 47.

Here, in the magnetic field generated by the magnetic-field generation means, magnetic flux H shown by arrows around the exciting coil 40 is repeatedly produced and extinguished upon application of an alternating electric current of 10 to 50 kHz in frequency from an excitation circuit (not shown). In a conductive layer (induction magnetic material) 47*b* in the heat-resistant endless film 47 which moves in this varying magnetic field, eddy current A as shown by an arrow is generated so as to lessen the change of the electric field by the aid of electromagnetic induction. This eddy current is converted into Joule heat by the skin effect (radio-frequency resistance) of the conductive layer, and consequently the conductive layer in the heat-resistant endless film 47 serves as the heating layer. Thus, the heat-resistant endless film 47 generates heat directly at its part near to the surface layer, and hence the rapid heating that does not depend on thermal conductivity and heat capacity of the film base layer and even on the thickness of the heat-resistant endless film can be materialized.

The transfer material P as a material to be heated, holding thereon a toner image T, passes the nip N in close contact with the heat-resistant endless film 47, thus a fixed image can be obtained on the transfer material P.

The cylindrical heat-resistant endless film 47 used in the heating and pressing means according to the present invention may preferably be a film consisting of at least three layers, a film base layer 47*a*, a conductive layer 47*b* and a surface layer 47*c*. For example, a heat-resistant resin such as polyimide is formed into the film base layer 47*a* in a thickness of from 10 μm to 100 μm. On the peripheral surface (the side coming into contact with the material to be heated) of this film base layer 47*a*, the conductive layer 47*b* is formed, e.g., in a thickness of from 1 μm to 100 μm by treatment such as plating with a metal such as Ni, Cu or Cr. On the free surface of the conductive layer 47*b*, the surface layer 47*c* is further formed, e.g., by applying a mixture of heat-resistant resins with good toner releasability, such as PFA and PTFE, or any of these. Also, the film base layer 47*a* may have a double layer structure to function as a conductive layer.

The coil core 42 is formed of, e.g., a material having a high permeability and a low residual magnetic flux density, such as ferrite and Permalloy. The use of the material having a low residual magnetic flux density can restrain the eddy current generated in the core itself, and hence the heat may no longer be generated from the coil core 42, bringing about an improvement in efficiency. Also, the use of the material having a high permeability enables the coil core 42 to serve as a path for the magnetic flux H to prevent the magnetic flux from leaking out as far as possible.

The exciting coil 40 is constituted of a bundle of a plurality of small-gauge wires (i.e., a bundled cable) made of copper individual wires of which have each been insulation-coated, with the bundle having been wound around the core several times. A sheet coil substrate may also be used which is formed by printing an exciting-coil pattern in multiple layers on the plane of a substrate made of a non-magnetic material such as a glass-fiber-filled epoxy resin (general-purpose electrical substrate) or ceramic.

The sliding plate 43 is constituted of a heat-resistant resin such as a liquid-crystal polymer or a phenolic resin, and has been coated with, e.g., a resin such as PFA or PTFE or a glass rich in slipperiness to provide a resin coat or a glass coat at its part facing the heat-resistant endless film 47 in order to lessen the frictional resistance with the heat-resistant endless film 47.

The pressure roller 48 is constituted of a mandrel around which a silicone rubber, a fluorine resin or the like is wound. This pressure roller 48 is provided in pressure contact with the bottom surface of the sliding plate 43 via the heat-resistant endless film 47 under a stated pressing force F by a bearing means and a pressing means (both not shown), and together with the sliding plate 43, forms the nip N in which the heat-resistant endless film 47 is held.

At the nip N, magnetic fields generated by the magnetic-field generation means concentrate, and hence the surface layer of the heat-resistant endless film 47 generates heat rapidly directly at the vicinity thereof. As a result, a great thermal shock is given to the surface of the heat-resistant endless film 47 and to the pressure roller 48, so that the releasability to the toner and so forth may lower and the close contact with the heat-resistant endless film 47 may become less ensured. However, the use of the toner of the present invention lessens the load on the above heating and pressing means and makes it possible to obtain good fixed images over a long period of time.

EXAMPLES

The present invention is described below by giving specific working examples. The present invention is by no means limited to these.

Pigment Treatment Example 1

In a four-necked container, 100 parts by weight of a red pigment (C.I. Pigment Red 150; in the chemical formula of the monoazo pigment described previously, $R_1$ is —$NH_2$, $R_2$ is —$OCH_3$, $R_3$ is —H and $R_4$ is —$CONC_6H_5$) was dispersed in 5,000 parts by weight of a $2.5\times10^{-3}$ mol/litter aqueous solution of $CaCl_2$ (adjusted to pH: 4.7). Then 20.5 parts by weight of a 5% by weight aqueous solution of the compound represented by the formula (1) (dehydroabietic acid) (pH: 10) was dropwise added with stirring at 200 rpm under the condition of 25° C. Thereafter, the temperature was raised to 100° C., and the mixture was stirred for 20 hours. The treated-pigment dispersion thus obtained was cooled to 25° C., followed by filtration, then drying at 50° C. for 20 hours, and thereafter pulverization by means of a hammer mill to obtain a treated pigment (1).

The treated pigment (1) was found from its THF-soluble matter and acetone-soluble matter to contain dehydroabietic acid (compound A) and a Ca salt of dehydroabietic acid (compound B) in an amount of 10% by weight in total in the pigment, having the value of X/Y of 4.0.

Pigment Treatment Example 2

The procedure of Pigment Treatment Example 1 was repeated except that a $1.5\times10^{-3}$ mol/litter aqueous solution of $CaCl_2$ (adjusted to pH: 4.7) was used instead and the 5% by weight aqueous solution of the compound represented by the formula (1) was dropwise added in an amount changed to 39.0 parts by weight. The treated pigment obtained was designated as a treated pigment (2).

The treated pigment (2) was found from its THF-soluble matter and acetone-soluble matter to contain dehydroabietic acid (compound A) and a Ca salt of dehydroabietic acid (compound B) in an amount of 19% by weight in total in the pigment, having the value of X/Y of 6.7.

Pigment Treatment Example 3

The procedure of Pigment Treatment Example 1 was repeated except that a $5.0\times10^{-3}$ mol/litter aqueous solution of $CaCl_2$ (adjusted to pH: 4.7) was used instead and the 5% by weight aqueous solution of the compound represented by the formula (1) was dropwise added in an amount changed to 116.9 parts by weight. The treated pigment obtained was designated as a treated pigment (3).

The treated pigment (3) was found from its THF-soluble matter and acetone-soluble matter to contain dehydroabietic acid (compound A) and a Ca salt of dehydroabietic acid (compound B) in an amount of 57% by weight in total in the pigment, having the value of X/Y of 0.2.

Pigment Treatment Example 4

The procedure of Pigment Treatment Example 1 was repeated except that a $1.0\times10^{-3}$ mol/litter aqueous solution of $CaCl_2$ (adjusted to pH: 4.7) was used instead and the 5% by weight aqueous solution of the compound represented by the formula (1) was dropwise added in an amount changed to 41.0 parts by weight. The treated pigment obtained was designated as a treated pigment (4).

The treated pigment (4) was found from its THF-soluble matter and acetone-soluble matter to contain dehydroabietic acid (compound A) and a Ca salt of dehydroabietic acid (compound B) in an amount of 20% by weight in total in the pigment, having the value of X/Y of 10.0.

Pigment Treatment Example 5

The procedure of Pigment Treatment Example 1 was repeated except that the compound represented by the formula (1) was changed for the compound represented by the formula (2) (abietic acid). The treated pigment obtained was designated as a treated pigment (5).

The treated pigment (5) was found from its THF-soluble matter and acetone-soluble matter to contain abietic acid (compound A) and a Ca salt of abietic acid (compound B) in an amount of 10% by weight in total in the pigment, having the value of X/Y of 4.0.

Pigment Treatment Example 6

The procedure of Pigment Treatment Example 1 was repeated except that the compound represented by the formula (1) was changed for the compound represented by the formula (2) (abietic acid) and the magenta pigment was changed for a cyan pigment (C.I. Pigment Blue 15:3). The treated pigment obtained was designated as a treated pigment (6).

The treated pigment (6) was found from its THF-soluble matter and acetone-soluble matter to contain abietic acid (compound A) and a Ca salt of abietic acid (compound B) in an amount of 10% by weight in total in the pigment, having the value of X/Y of 4.0.

Dehydroabietic Acid Ca Salt

Production Example

In a four-necked container, 100 parts by weight of a 5% by weight aqueous solution of the compound represented by the formula (1) (pH: 10) was dropwise added to a 0.1 mol/litter aqueous solution of $CaCl_2$ (adjusted to pH: 4.7) with stirring at 200 rpm under the condition of 25° C. The white crystal matter deposited was filtered and then thoroughly washed with acetone to remove dehydroabietic acid having no salt structure. The crystal matter thus washed was dried at 50° C. for 20 minutes to obtain a Ca salt of dehydroabietic acid.

Dehydroabietic Acid Ba Salt

Production Example

In a four-necked container, 100 parts by weight of a 5% by weight aqueous solution of the compound represented by the formula (1) (pH: 10) was dropwise added to an aqueous solution of 0.1 mol/litter of $BaCl_2$ (adjusted to pH: 4.7) with stirring at 200 rpm under the condition of 25° C. The white crystal matter deposited was filtered and then thoroughly washed with acetone to remove dehydroabietic acid having no salt structure. The crystal matter thus washed was dried at 50° C. for 20 minutes to obtain a Ba salt of dehydroabietic acid.

Abietic Acid Ca Salt

Production Example

In a four-necked container, 100 parts by weight of a 5% by weight aqueous solution of the compound represented by the formula (2) (pH: 10) was dropwise added to a 0.1 mol/litter aqueous solution of $CaCl_2$ (adjusted to pH: 4.7) with stirring at 200 rpm under the condition of 25° C. The white crystal matter having come deposited was filtered and then thoroughly washed with acetone to remove abietic acid having no salt structure. The crystal matter thus washed was dried at 50° C. for 20 minutes to obtain a Ca salt of abietic acid.

Abietic Acid Ethyl Ester

Production Example

Into a four-necked container, a mixture of 100 parts by weight of ethanol, 20 parts by weight of abietic acid and 10 parts by weight of concentrated sulfuric acid was introduced, which was then refluxed for 3 hours. Thereafter, this was cooled to room temperature, and then 300 parts by weight of water was added, followed by further addition of sodium carbonate to adjust the pH in the container to 10. Next, the oily matter was extracted with diethyl ether three times, and the diethyl ether was washed with water, followed by drying. The diethyl ether was evaporated off, followed by distillation under reduced pressure to obtain an ethyl ester of abietic acid.

Toner Production Example 1

Into a four-necked container, 360 parts by weight of ion-exchanged water and 430 parts by weight of a 0.1 mol/liter aqueous solution of $Na_3PO_4$ were introduced, and these were stirred at 15,000 rpm by means of a high-speed stirrer, Kurea mixer, while the temperature was maintained at 60° C. To the mixture obtained, 10 parts by weight of 1N hydrochloric acid was added, and thereafter 34 parts by weight of a 1.0 mol/liter aqueous solution of $CaCl_2$ was slowly added to prepare an aqueous dispersion medium containing fine-particle slightly water-soluble dispersion stabilizer $Ca_3(PO_4)_2$. Here, the pH of the aqueous medium was 5.3.

| | (by weight) |
|---|---|
| Styrene monomer | 83 parts |
| n-Butyl acrylate | 17 parts |
| Divinylbenzene | 0.11 part |
| Treated pigment (1) | 5 parts |
| Polyester resin (Mw: 25,000; acid value: 15 mg · KOH/g) | 5 parts |
| Dialkylsalicylic acid | 0.03 part |
| Ester wax (Mn: 10,000; Mw/Mn: 1.9; melting point: 60° C.) | 15 parts |

Meanwhile, as a disperse phase, a mixture comprised of the above materials was dispersed for 3 hours by means of an attritor (manufactured by Mitsui Mining & Smelting Co., Ltd.), followed by addition of 3 parts by weight of a polymerization initiator 2,2'-azobis(2,4-dimethylvaleronitrile) to prepare a polymerizable monomer composition.

Next, the polymerizable monomer composition was introduced into the above aqueous dispersion medium to granulate the polymerizable monomer composition with stirring for 4 minutes in an atmosphere of $N_2$ at an internal temperature of 60° C. while maintaining the number of revolutions of the high-speed stirrer at 15,000 rpm. Thereafter, the stirrer was replaced with a stirrer having paddle stirring blades, and the same temperature was maintained and the system was stirred at 200 rpm to carry out polymerization for 5 hours.

After the polymerization was completed, sodium hydrogencarbonate was added to the aqueous medium to adjust its pH to 11 again, and distillation was carried out for 5 hours at an internal temperature of 60° C. under a reduced pressure of 350 mmHg. Then, after cooling, diluted hydrochloric acid was added to adjust the pH of the aqueous dispersion medium to 1.2 to dissolve the slightly water-soluble dispersion stabilizer. After solid-liquid separation was further carried out by filtration under pressure, the solids formed were washed with 18,000 parts of water, followed by drying at 45° C. for 4 hours by means of a fluidized-bed dryer (manufactured by Ohkawara Seisakusho K.K.) to obtain magenta-color toner particles with a weight-average particle diameter of 7.1 $\mu$m.

Next, 100 parts by weight of the above toner particles and 0.7 part by weight of fine silica particles subjected to hydrophobicity treatment (specific surface area: 120 $m^2/g$) were mixed by a dry process. The toner thus obtained was designated as a toner (A).

The values of A, A/B and X/Y in the toner (A) are shown in Table 1.

Toner Production Example 2

A toner was produced in the same manner as in Toner Production Example 1 except that in place of the divinylbenzene 0.4 part by weight of ethylene glycol diacrylate was added and also in place of the treated pigment (1) 6.15 parts by weight of the treated pigment (2) was added. The toner thus obtained was designated as a toner (B).

The values of A, A/B and X/Y in the toner (B) are shown in Table 1.

Toner Production Example 3

A toner was produced in the same manner as in Toner Production Example 1 except that in place of the treated pigment (1) 5 parts by weight of an untreated yellow pigment C.I. Pigment Yellow 93 was used, the divinylbenzene was added in an amount of 0.0033 part by weight and further 0.15 part by weight of the compound of the formula (2) (abietic acid) and 0.15 part by weight of an ethyl ester of abietic acid were added to the polymerizable monomer composition. The toner thus obtained was designated as a toner (C).

The values of A, A/B and X/Y in the toner (C) are shown in Table 1.

Toner Production Example 4

A toner was produced in the same manner as in Toner Production Example 1 except that in place of the treated pigment (1) 3 parts by weight of an untreated red pigment C.I. Pigment Red 150 was used and 2 parts by weight of the compound of the formula (1) (dehydroabietic acid) and 5 parts by weight of a Ba salt of dehydroabietic acid were added to the polymerizable monomer composition. The toner thus obtained was designated as a toner (D).

The values of A, A/B and X/Y in the toner (D) are shown in Table 1.

Toner Production Example 5

A toner was produced in the same manner as in Toner Production Example 1 except that in place of the treated pigment (1) 10.5 parts by weight of the treated pigment (3) was added. The toner thus obtained was designated as a toner (E).

The values of A, A/B and X/Y in the toner (E) are shown in Table 1.

Toner Production Example 6

A toner was produced in the same manner as in Toner Production Example 1 except that in place of the treated pigment (1) 5.6 parts by weight of the treated pigment (4) was added. The toner thus obtained was designated as a toner (F).

The values of A, A/B and X/Y in the toner (F) are shown in Table 1.

Toner Production Example 7

A toner was produced in the same manner as in Toner Production Example 1 except that in place of the treated pigment (1) 3 parts by weight of an untreated cyan pigment C.I. Pigment Blue 15:3 was used and 2 parts by weight of the compound of the formula (2) (abietic acid) and 5 parts by weight of a Ca salt of abietic acid were added to the polymerizable monomer composition. The toner thus obtained was designated as a toner (G).

The values of A, A/B and X/Y in the toner (G) are shown in Table 1.

Toner Production Example 8

A toner was produced in the same manner as in Toner Production Example 1 except that in place of the treated pigment (1) 8 parts by weight of carbon black (BET specific surface area: 65 $m^2/g$; DBP oil absorption: 42 ml/100 g) and 2 parts by weight of the compound of the formula (2) (abietic acid) and 5 parts by weight of a Ca salt of abietic acid were added to the polymerizable monomer composition. The toner thus obtained was designated as a toner (H).

The values of A, A/B and X/Y in the toner (H) are shown in Table 1.

Toner Production Example 9

A toner was produced in the same manner as in Toner Production Example 1 except that in place of the treated pigment (1) the treated pigment (5) was added. The toner thus obtained was designated as a toner (I).

The values of A, A/B and X/Y in the toner (I) are shown in Table 1.

Toner Production Example 10

A toner was produced in the same manner as in Toner Production Example 1 except that in place of the treated pigment (1) the treated pigment (6) was added. The toner thus obtained was designated as a toner (J).

The values of A, A/B and X/Y in the toner (J) are shown in Table 1.

Comparative-Toner Production Example 1

A toner was produced in the same manner as in Toner Production Example 1 except that in place of the treated pigment (1) 4.5 parts by weight of an untreated red pigment C.I. Pigment Red 150 was added and 0.04 part by weight of the compound of the formula (1) (dehydroabietic acid) and 0.01 part by weight of a Ca salt of dehydroabietic acid were added to the polymerizable monomer composition. The toner thus obtained was designated as a toner (a).

The values of A, A/B and X/Y in the toner (a) are shown in Table 1.

Comparative-Toner Production Example 2

A toner was produced in the same manner as in Toner Production Example 1 except that in place of the treated pigment (1) 4.5 parts by weight of an untreated red pigment C.I. Pigment Red 150 was added, and also the divinylbenzene (purity: 55% by weight) was used in an amount of 0.3 part by weight and 8 parts by weight of the compound of the formula (1) (dehydroabietic acid) and 2 parts by weight of a Ca salt of dehydroabietic acid were added to the polymerizable monomer composition. The toner thus obtained was designated as a toner (b).

The values of A, A/B and X/Y in the toner (b) are shown in Table 1.

Comparative-Toner Production Example 3

A toner was produced in the same manner as in Toner Production Example 1 except that in place of the treated pigment (1) 4.5 parts by weight of an untreated red pigment C.I. Pigment Red 150 was added, and also the divinylbenzene (purity: 55% by weight) was used in an amount of 15 parts by weight and 0.4 part by weight of the compound of the formula (1) (dehydroabietic acid) and 0.1 part by weight of a Ca salt of dehydroabietic acid were added to the polymerizable monomer composition. The toner thus obtained was designated as a toner (c).

The values of A, A/B and X/Y in the toner (c) are shown in Table 1.

Comparative-Toner Production Example 4

A toner was produced in the same manner as in Toner Production Example 1 except that in place of the treated pigment (1) 4.5 parts by weight of an untreated red pigment C.I. Pigment Red 150 was added, the divinylbenzene (purity: 55% by weight) was used in an amount of 15 parts by weight and 0.4 part by weight of the compound of the formula (1) (dehydroabietic acid) and 0.1 part by weight of a Ca salt of dehydroabietic acid were added to the polymerizable monomer composition. The toner thus obtained was designated as a toner (d).

The values of A, A/B and X/Y in the toner (d) are shown in Table 1.

TABLE 1

| | Toner | A | A/B | X/Y |
|---|---|---|---|---|
| Toner Production Example: | | | | |
| 1 | (A) | 0.39 | 4.5 | 4.0 |
| 2 | (B) | 0.89 | 2.9 | 6.7 |
| 3 | (C) | 0.23 | 60.6 | 1.0 |
| 4 | (D) | 5.25 | 63.6 | 0.4 |
| 5 | (E) | 4.49 | 54.5 | 0.2 |
| 6 | (F) | 0.85 | 10.0 | 10.0 |
| 7 | (G) | 5.25 | 63.6 | 0.4 |
| 8 | (H) | 5.06 | 63.6 | 0.4 |
| 9 | (I) | 0.39 | 4.5 | 4 |
| 10 | (J) | 0.39 | 4.5 | 4 |
| Comparative-Toner Production Example: | | | | |
| 1 | (a) | 0.04 | 0.5 | 4.0 |
| 2 | (b) | 7.26 | 60.6 | 4.0 |
| 3 | (c) | 0.35 | 0.06 | 4.0 |
| 4 | (d) | 0.39 | 90.9 | 4.0 |

Example 1

The toner (A) was used as a developer, and this developer was used in an image-forming apparatus shown in FIG. 1 to make image evaluation. The image-forming apparatus is as described below.

FIG. 1 is a schematic illustration of a remodeled machine of a 1,200 dpi laser beam printer LBP-840 (manufactured by CANON INC.), which utilizes an electrophotographic process of a non-magnetic one-component contact developing system. In this Example, an appratus remodeled on the following portions (a) to (g) was used.

(a) The process speed was changed to 65 mm/s.

(b) As a charging system, contact charging was employed in which charging is performed by bringing a rubber roller 2 into contact with an image-bearing member (photosensitive member) 1, and as applied voltage only a DC component (−1,200 V) was applied.

(c) A toner-carrying member 4 was changed to a medium-resistance rubber roller comprised of silicone rubber with carbon black dispersed therein (diameter: 16 mm; Asker-C hardness: 45 degrees; resistance: $10^5$ Ω·cm), which was set in contact with the photosensitive member.

(d) The toner-carrying member was rotated in the same direction at the part coming in contact with the photosensitive member and was so driven as to be at a peripheral speed which was 140% with respect to the peripheral speed of the rotation of the photosensitive member.

(e) As a means for coating the toner-carrying member with a toner 5 (developer), a coating toller 6 comprised of foamed urethane rubber was provided, and was set in contact with the toner-carrying member. A voltage of about −550 V was applied to the coating roller.

(f) In order to control the coat layer on the toner-carrying member, a resin-coated blade 3 made of stainless steel was used.

(g) As the applied voltage at the time of development, only a DC component (−450 V) was applied.

The remodeled apparatus has a process in which the photosensitive member is electrostatically charged by using the roller type charging assembly (only DC voltage is applied) and then image areas are exposed to laser light to form an electrostatic latent image, which is then developed with the toner to form a visible image (toner image), and thereafter the toner image is transferred to a transfer material by means of a roller to which a voltage of +700 V is kept applied.

As to the charge potential of the photosensitive member, the dark-area potential was set to −580 V, and the light-area potential −150 V.

In the fixing assembly, the heating and pressing means on a heat roller system as shown in FIG. 2 was used, which is not provided with any separation claws and any mechanism for applying the offset-preventive liquid.

As the heating roller, used was a roller having a cylindrical mandrel made of aluminum having been primer-treated and thereafter provided with an elastic layer of dimethylsilicone rubber and further, via a primer layer, a surface layer formed of a 50 μm thick PFA tube. Meanwhile, as the pressure roller, used was a roller having a cylindrical mandrel made of stainless steel having been primer-treated and thereafter provided thereon with an elastic layer of dimethylsilicone rubber and further thereon, via a primer layer, a surface layer formed of a 50 μm thick PFA tube.

In the interior of the cylindrical mandrel of the heating roller, a halogen heater was provided as the heating member. The pressure roller was so set that it was kept in contact with the heating roller at a contact pressure of 245 N (25 kgf) and a nip of 5 mm in width was formed between them.

As to evaluation methods, evaluation was made at the initial stage on image peeling, fixing performance in the low-temperature region and high-temperature region, and OHT transparency. Then, in respect of those on the tolerable level (rank C) or higher in all items, printing was carried out on up to 10,000 sheets and evaluation was made on matching for the photosensitive member (drum), image density and fog. Here, in the print evaluation, an image pattern having an image area percentage of 4% on A4-size paper was used.

Good results were obtained in respect of the image peeling, fixing performance and OHT transparency. Good results were also obtained in respect of all items even in the 10,000-sheet print evaluation. The evaluation results are shown in Table 2.

Evaluation methods are as shown below. In Examples 2 to 6 and Comparative Examples 1 to 4 given later, too, evaluation is made according to these methods.

Image peeling:

Evaluated by the number of image peeling having appeared on images when a solid image (size: 2 cm×5 cm;

toner laid-on quantity: 0.8 mg/cm$^2$) was printed on a little thick transfer paper (basis weight: 105 g/m$^2$; A4-size paper).

A: Nothing appears.

B: Appears at 1 to 5 spots.

C: Appears at 6 to 10 spots.

D: Appears at 11 spots or more (or image peeling of 2 mm or more in diameter appears).

Fixing Performance in Low-temperature Region:

Evaluated by printing a solid image (toner laid-on quantity: 0.6 mg/cm$^2$) on transfer paper (basis weight: 75 g/m$^2$; A4-size paper), changing fixing temperature (130 to 175° C.). Here, the fixing temperature is the value found by measuring with a non-contact thermometer the surface temperature of the fixing roller.

A: No offset at 130° C. or above.

B: No offset at 150° C. or above, and offset occurs at below 150° C.

C: No offset at 170° C. or above, and offset occurs at below 170° C.

D: Offset occurs even at 170° C. or above.

Fixing performance in high-temperature region:

Evaluated by printing a solid image (toner laid-on quantity: 0.6 mg/cm$^2$) on transfer paper (basis weight: 75 g/m$^2$; A4-size paper), changing fixing temperature (175 to 220° C.). Here, the fixing temperature is the value found by measuring with a non-contact thermometer the surface temperature of the fixing roller.

A: No offset at 220° C. or below.

B: No offset at 200° C. or below, and offset occurs at above 150° C.

C: No offset at 180° C. or below, and offset occurs at above 180° C.

D: Offset occurs even at 180° C. or below.

OHT Transparency:

To evaluate the transparency of transparency film (OHT), a solid image with a toner laid-on quantity of 0.6 mg/cm$^2$ was formed on OHT, and the OHT film obtained was projected through an overhead projector (OHP), where the projected image obtained was evaluated.

A: The projected image is free from any offset, is superior in transparency, has no non-uniformity in shading or tone, and has good color reproducibility.

B: The projected image has a little non-uniformity in shading or tone, but is on the level of no problem.

C: The projected image has non-uniformity in shading or tone and poor color reproducibility, but is on the tolerable level.

D: The projected image has very poor transparency and its color is little reproduced.

Matching for Photosensitive Drum:

After the printing test was finished at the initial stage, on 5,000 sheets and on 10,000 sheets, evaluation was visually made by examining any scratches on the photosensitive drum, any sticking of toner thereto and how they affected printed images.

A: No sticking occurs.

B: Scratches occur on the blade surface, but sticking little occurs.

C: Sticking is seen, but its influence on images is slight.

D: Sticking is greatly seen, and image defects appear.

Image Density:

Evaluated by image density of solid areas after the printing test was finished at the initial stage, on 5,000 sheets and on 10,000 sheets. Here, the image density was measured with MACBETH REFLECTION DENSITOMETER RD918 (trade name; manufactured by Macbeth Co.), as relative density with respect to an image printed on a white ground area with a density of 0.00 of an original.

A: 1.40 or more.

B: From 1.35 to less than 1.40.

C: From 1.00 to less than 1.35.

D: Less than 1.00.

Image Fog:

Using REFLECTOMETER MODEL TC-6DS (trade name; manufactured by Tokyo Denshoku Co., Ltd.), the reflectance (%) at non-image areas of printed images is measured. The reflectance measured is subtracted from the reflectance (%) measured in the same way on virgin printing paper (reference paper). The numerical value (%) obtained is used to make evaluation. It follows that the smaller the numerical value is, the better the image fog is restrained. The evaluation on the image fog was made after 5,000-sheet and 10,000-sheet printing tests were finished.

A: Less than 0.5%.

B: From 0.5% to less than 1.0%.

C: From 1.0% to less than 5.0%.

D: More than 5.0%.

Example 2

Printing tests were conducted on the toner (B) by the same evaluation methods as the above. As the result, the image peeling, the fixing performance and the OHT transparency were a little inferior to those in Example 1, but substantially good results were obtained. The evaluation results are shown in Table 2.

Example 3

Printing tests were conducted on the toner (C) by the same evaluation methods as the above. As the result, the image peeling and the fixing performance were a little inferior to those in Example 1, but substantially good results were obtained. The evaluation results are shown in Table 2.

Example 4

Printing tests were conducted on the toner (D) by the same evaluation methods as the above. As the result, the fixing performance was a little inferior to that in Example 1, but substantially good results were obtained. The evaluation results are shown in Table 2.

Example 5

Printing tests were conducted on the toner (E) by the same evaluation methods as the above. As the result, the OHT transparency was a little inferior to that in Example 1, but on the level of no problem. The evaluation results are shown in Table 2.

Example 6

Printing tests were conducted on the toner (F) by the same evaluation methods as the above. As the result, the OHT transparency was a little inferior to that in Example 1, but on the level of no problem. The evaluation results are shown in Table 2.

Comparative Example 1

Printing tests were conducted on the toner (a) by the same evaluation methods as the above. As the result, the image peeling occurred greatly, and hence the evaluation was stopped. The evaluation results are shown in Table 2.

Comparative Example 2

Printing tests were conducted on the toner (b) by the same evaluation methods as the above. As the result, the matching for photosensitive drum, the image density and the image fog became greatly poor when the tests were finished on 5,000 sheets and 10,000 sheets. The evaluation results are shown in Table 2.

Comparative Example 3

Printing tests were conducted on the toner (c) by the same evaluation methods as the above. As the result, the image peeling occurred greatly and the fixing performance in the low-temperature region became greatly poor, and hence the evaluation was stopped. The evaluation results are shown in Table 2.

Comparative Example 4

Printing tests were conducted on the toner (d) by the same evaluation methods as the above. As the result, the fixing performance in the high-temperature region became greatly poor, and hence the evaluation was stopped. The evaluation results are shown in Table 2.

Example 7

Evaluation was made in the same manner as in Example 4 except that, as the mechanism for applying the offset-preventive liquid, a roller impregnated with dimethylsilicone oil was brought into contact with the heating roller of the heating and pressing means and was so set that the consumption of the offset-preventive liquid applied to the surface coming into contact with the toner image on the transfer material came to be 0.015 to 0.020 mg/cm$^2$.

As the result, though the images obtained was a little glossy, some improvement was seen in the fixing performance in high-temperature region. The evaluation results are shown in Table 2.

TABLE 2

| | | | Fixing performance in | | | (Initial stage/ 5,000 sheets/10,000 sheets) | | |
|---|---|---|---|---|---|---|---|---|
| | Toner | Image peeling | low-temp. region | high-temp. region | OHT trans-parency | Matching for photosensi-tive drum | Image density | Fog |
| Example: | | | | | | | | |
| 1 | (A) | A | A | A | A | A/A/A | A/A/A | A/A/A |
| 2 | (B) | B | B | A | B | A/A/A | A/A/A | A/A/A |
| 3 | (C) | B | A | B | A | A/A/A | A/A/A | A/A/A |
| 4 | (D) | A | A | B | B | A/B/B | A/B/C | A/C/C |
| 5 | (E) | A | A | A | C | A/A/A | A/A/A | A/A/A |
| 6 | (F) | A | A | A | C | A/A/A | A/A/A | A/A/A |
| Comparative Example: | | | | | | | | |
| 1 | (a) | D | B | A | A | — | — | — |
| 2 | (b) | A | A | A | A | B/C/D | C/D/D | C/C/D |
| 3 | (c) | D | D | A | A | — | — | — |
| 4 | (d) | A | A | D | A | — | — | — |
| 7 | (D) | A | A | A | B | A/B/B | A/B/C | A/C/C |

Example 8

In the image-forming apparatus used for evaluation in Example 1, the heating and pressing means on such a film system as shown in FIGS. 4A and 4B were used, which is not provided with any separation claws and any mechanism for applying the offset-preventive liquid.

As the heat-resistant endless film, used was a 60 $\mu$m thick polyimide film having on the side coming into contact with the transfer material a low-resistance release layer of PTFE with a conductive material dispersed therein. As the pressure roller, used was a roller having a mandrel made of stainless steel having been primer-treated and thereafter provided with an elastic layer of dimethylsilicone rubber foam and further, via primer layers, an elastic layer of dimethylsilicone rubber and a 20 $\mu$m thick surface layer of PTFE.

In the interior of the heat-resistant endless film, a low heat capacitance linear heating medium provided on a heater substrate with a heat-resistant surface protective layer by screen printing was also placed as the heating medium, and was so set that a contact pressure of 96 N (10 kgf) was applied to the heating medium and pressure roller via the heat-resistant endless film and a nip of 5 mm in width was formed between them.

Using this heating and pressing means, image evaluation (the initial stage only) was made for the toner (A) on image peeling, fixing performance in the low-temperature region and high-temperature region, and OHT transparency. As the result, substantially good results were obtained. The evaluation results are shown in Table 3.

The evaluation was made by the same methods as those in Example 1. The evaluation was also made in the same way in respect of the following Examples 9 and 10 and Comparative Examples 5 and 6, too.

Example 9

Evaluation was made in the same manner as in Example 8 except that the toner (C) was used as the toner for evaluation. As the result, substantially good results were obtained. The evaluation results are shown in Table 3.

Example 10

Evaluation was made in the same manner as in Example 8 except that the toner (D) was used as the toner for evaluation. As the result, substantially good results were obtained. The evaluation results are shown in Table 3.

Comparative Example 5

Evaluation was made in the same manner as in Example 8 except that the toner (a) was used as the toner for evaluation. As the result, the image peeling occurred greatly, and hence the evaluation was stopped. The evaluation results are shown in Table 3.

Comparative Example 6

Evaluation was made in the same manner as in Example 8 except that the toner (c) was used as the toner for evaluation. As the result, the image peeling occurred greatly and the fixing performance in the low-temperature region became greatly poor, and hence the evaluation was stopped. The evaluation results are shown in Table 3.

TABLE 3

| | Toner | Image peeling | Fixing performance in low-temp. region | Fixing performance in high-temp. region | OHT transparency | (Initial stage/5,000 sheets/10,000 sheets) Matching for photosensitive drum | Image density | Fog |
|---|---|---|---|---|---|---|---|---|
| Example: | | | | | | | | |
| 8 | (A) | A | A | A | A | A/A/A | A/A/A | A/A/A |
| 9 | (C) | B | A | B | B | A/A/A | A/A/A | A/A/A |
| 10 | (D) | B | A | B | B | A/B/B | A/B/B | A/B/B |
| Comparative Example: | | | | | | | | |
| 5 | (a) | D | B | A | B | — | — | — |
| 6 | (c) | D | D | A | B | — | — | — |

Example 11

In the image-forming apparatus used for evaluation in Example 1, the heating and pressing means on an electromagnetic-induction system was used, which is not provided with any separation claws and any mechanism for applying the offset-preventive liquid.

As the heat-resistant endless film, used was a triple-layer structure having a 50 $\mu$m thick cylindrical nickel film material as a resistance layer (heating layer) which generates heat by electromagnetic induction, the peripheral surface of which is covered with an elastic layer comprised of dimethylsilicone rubber and a release layer comprised of PFA. Meanwhile, as the pressure roller, used was a roller having a mandrel made of stainless steel having been primer-treated and thereafter provided with an elastic layer of dimethylsilicone rubber foam and further, via primer layers, an elastic layer of dimethylsilicone rubber and a 50 $\mu$m thick PFA tube surface layer.

In the interior of the heat-resistant endless film, a magnetic-field generation means was placed, and was so set that a contact pressure of 245 N (25 kgf) was applied to the magnetic-field generation means and pressure roller via the heat-resistant endless film and a nip of 6 mm in width was formed between them.

Using this heating and pressing means, image evaluation (the initial stage only) was made on the toner (A) to make evaluation on image peeling, fixing performance in the low-temperature region and high-temperature region, and OHT transparency. As the result, substantially good results were obtained. The evaluation results are shown in Table 4.

The evaluation was made by the same methods as those in Example 1. The evaluation was also made in the same way in respect of the following Examples 12 to 17 and Comparative Examples 7 and 8, too.

Example 12

Evaluation was made in the same manner as in Example 11 except that the toner (C) was used as the toner for evaluation. As the result, substantially good results were obtained. The evaluation results are shown in Table 4.

Example 13

Evaluation was made in the same manner as in Example 11 except that the toner (D) was used as the toner for evaluation. As the result, substantially good results were obtained. The evaluation results are shown in Table 4.

Comparative Example 7

Evaluation was made in the same manner as in Example 11 except that the toner (a) was used as the toner for evaluation. As the result, the image peeling occurred greatly, and hence the evaluation was stopped. The evaluation results are shown in Table 4.

Comparative Example 8

Evaluation was made in the same manner as in Example 11 except that the toner (c) was used as the toner for evaluation. As the result, the image peeling occurred greatly and the fixing performance in the low-temperature region became greatly poor, and hence the evaluation was stopped. The evaluation results are shown in Table 4.

Examples 14 to 17

Evaluation was made in the same manner as in Example 11 except that the toners (G) to (J), respectively, were used as the toner for evaluation. As the result, substantially good results were obtained. The evaluation results are shown in Table 4.

TABLE 4

| | Toner | Image peeling | Fixing performance in low= temp. region | Fixing performance in high= temp. region | OHT transparency | (Initial stage/5,000 sheets/10,000 sheets) Matching for photosensitive drum | Image density |
|---|---|---|---|---|---|---|---|
| Example: | | | | | | | |
| 11 | (A) | A | A | A | A | A/A/A | A/A/A |
| 12 | (C) | B | B | B | B | A/A/A | A/A/A |
| 13 | (D) | B | B | B | B | A/B/B | A/B/B |
| 14 | (G) | B | B | B | B | A/A/A | A/A/A |
| 15 | (H) | B | B | B | B | A/A/A | A/A/A |
| 16 | (I) | B | B | B | B | A/A/B | A/A/B |
| 17 | (J) | B | B | B | B | A/A/B | A/A/B |
| Comparative Example: | | | | | | | |
| 7 | (a) | D | C | A | B | — | — |
| 8 | (c) | D | D | A | B | — | — |

What is claimed is:

1. A toner which comprises i) a binder resin containing a cross-linking agent component, ii) a colorant, iii) a compound (A) and iv) a compound (B);

said compound (A) being a compound selected from the group consisting of abietic acid, dehydroabietic acid, dihydroabietic acid, neoabietic acid, pimaric acid, isopimaric acid, levopimaric acid, pulstric acid, sandaracopimaric acid, secodehydroabietic acid and agathic acid; said compound (B) being a derivative of the compound included in the group from which said compound (A) is selected; and the total content A (% by weight: based on the weight of the toner) of said compound (A) and compound (B) in said toner being from 0.2% by weight to 6% by weight, and, where the content of said cross-linking agent component in said binder resin is represented by B (% by weight: based on the weight of the toner), satisfying the relationship of:

$$0.1 \leqq A/B \leqq 70.$$

2. The toner according to claim 1, wherein the content X (% by weight: based on the weight of the toner) of said compound (A) and the content Y (% by weight: based on the weight of the toner) of said compound (B) satisfy the relationship of:

$$0.25 \leqq X/Y \leqq 9.$$

3. The toner according to claim 1, wherein said compound (B) is a compound having a salt structure, and forms a salt with a cation selected from the group consisting of $K^+$, $Na^+$, $Ca^{2+}$, $Ba^{2+}$, $Al^{3+}$ and $NH_4^+$.

4. The toner according to claim 1, wherein said compound (B) is an ester compound.

5. The toner according to claim 1, wherein said cross-linking agent component is divinylbenzene.

6. The toner according to claim 1, wherein said colorant is a magenta colorant, and is a monoazo colorant represented by the following structural formula:

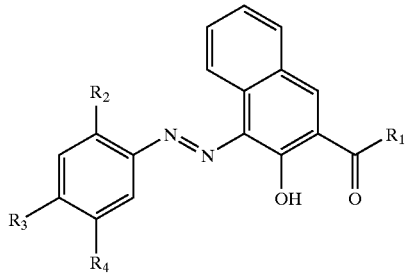

wherein $R_1$ is selected from —OH, —$NH_2$,

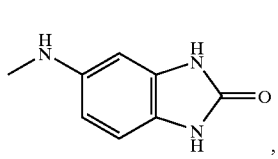

,

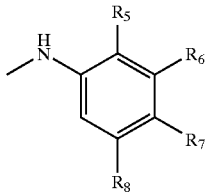

wherein $R_5$ to $R_8$ are each independently a hydrogen atom or a substituent selected from a halogen atom, an alkyl group, an alkoxyl group and a nitro group; and $R_2$ to $R_4$ are each independently a hydrogen atom or a substituent selected from a halogen atom, an alkyl group, an alkoxyl group, a nitro group, an anilido group and a sulfamoyl group.

7. The toner according to claim 6, wherein said monoazo colorant is a compound selected from the group consisting of C.I. Pigment Red 5, C.I. Pigment Red 31, C.I. Pigment Red 146, C.I. Pigment Red 147, C.I. Pigment Red 150, C.I. Pigment Red 184 and C.I. Pigment Red 269 (each according to what is named in Color Index, Fourth Edition).

8. The toner according to claim 1, wherein said colorant is a yellow colorant, and is a compound selected from the group consisting of C.I. Pigment Yellow 17, C.I. Pigment Yellow 74, C.I. Pigment Yellow 93, C.I. Pigment Yellow 155 and C.I. Pigment Yellow 180 (each according to what is named in Color Index, Fourth Edition).

9. The toner according to claim 1, wherein said colorant is a cyan colorant, and is a compound selected from the group consisting of C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66 (each according to what is named in Color Index, Fourth Edition).

10. The toner according to claim 1, wherein said colorant is a black colorant, and is carbon black or a magnetic material.

11. An image-forming method which comprises (a) a charging step of charging electrostatically an image-bearing member for holding thereon an electrostatic latent image; (b) an exposure step of forming by exposure the electrostatic latent image on the image-bearing member thus charged; (c) a developing step of developing the electrostatic latent image by means of a toner held on the surface of a toner-carrying member, to form a toner image; (d) a transfer step of transferring the toner image formed on the surface of the image-bearing member, to a transfer material via, or not via, an intermediate transfer member; and (e) a fixing step of fixing the toner image transferred onto the transfer material, to the transfer material by a heating and pressing means;

said toner being a toner which contains at least i) a binder resin containing a cross-linking agent component, ii) a colorant, iii) a compound (A) and iv) a compound (B);

said compound (A) being a compound selected from the group consisting of abietic acid, dehydroabietic acid, dihydroabietic acid, neoabietic acid, pimaric acid, isopimaric acid, levopimaric acid, pulstric acid, sandaracopimaric acid, secodehydroabietic acid and agathic acid; said compound (B) being a derivative of the compound included in the group from which said compound (A) is selected; and the total content A (% by weight: based on the weight of the toner) of said compound (A) and compound (B) in said toner being from 0.2% by weight to 6% by weight, and, where the content of said cross-linking agent component in said binder resin is represented by B (% by weight: based on the weight of the toner), satisfying the relationship of:

$$0.1 \leqq A/B \leqq 70.$$

12. The image-forming method according to claim 11, wherein said heating and pressing means is a means in which (i) it has a rotary heating member having at least a heating medium and has a rotary pressure member coming in contact with the rotary heating member to form a nip, (ii) an offset-preventive liquid applied to the surface coming into contact with the toner image held on the transfer material is set at a consumption of 0.025 mg/cm$^2$ or less (based on unit area of the transfer material) and (iii) the toner image held on the transfer material is heated and pressed at the nip.

13. The image-forming method according to claim 12, wherein as said heating and pressing means a heating and pressing means on a heat roller system is used which has as said rotary heating member a cylindrical heating roller having in its interior a heating medium and is not provided with any cleaning member for removing fixing-residual toner and any separation member for preventing a transfer material from winding around the heating and pressing means.

14. The image-forming method according to claim 12, wherein as said heating and pressing means a heating and pressing means on a film system is used which has as said rotary heating member a cylindrical heat-resistant endless film having in its interior a heating medium fastened to and supported on a support, and movable in pressure contact with the heating medium, and heats and presses the toner image via the endless film.

15. The image-forming method according to claim 12, wherein as said heating and pressing means a heating and pressing means on an electromagnetic induction system is used which has as said rotary heating member a heating medium comprising a cylindrical heat-resistant endless film having in its interior a magnetic-field generation means and having a heating layer which generates heat by electromagnetic induction by the action of the magnetic-field generation means.

16. The image-forming method according to claim 11, wherein in said developing step a toner layer of the toner held on the surface of said toner-carrying member comes into contact with the surface of the image-bearing member to develop the electrostatic latent image.

17. The image forming method according to claim 11, wherein the content X (% by weight: based on the weight of the toner) of said compound (A) and the content Y (% by weight: based on the weight of the toner) of said compound (B) satisfy the relationship of:

$$0.25 \leqq X/Y \leqq 9.$$

18. The image forming method according to claim 11, wherein said compound (B) is a compound having a salt structure, and forms a salt with a cation selected from the group consisting of $K^+$, $Na^+$, $Ca^{2+}$, $Ba^{2+}$, $Al^{3+}$ and $NH_4^+$.

19. The image forming method according to claim 11, wherein said compound (B) is an ester compound.

20. The image forming method according to claim 11, wherein said cross-linking agent component is divinylbenzene.

21. The image forming method according to claim 11, wherein said colorant is a magenta colorant, and is a monoazo colorant represented by the following structural formula:

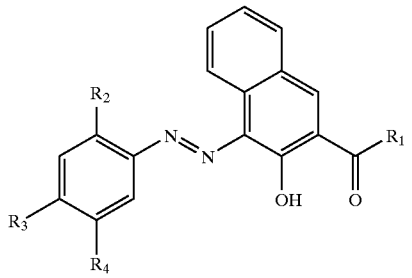

wherein $R_1$ selected from —OH, —$NH_2$,

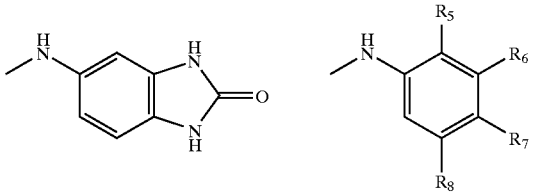

wherein $R_5$ to $R_8$ are each independently a hydrogen atom or a substituent selected from a halogen atom, an alkyl group, an alkoxyl group and a nitro group; and $R_2$ to $R_4$ are each independently a hydrogen atom or a substituent selected from a halogen atom, an alkyl group, an alkoxyl group, a nitro group, an anilido group and a sulfamoyl group.

22. The image forming method according to claim 21, wherein said monoazo colorant is a compound selected from the group consisting of C.I. Pigment Red 5, C.I. Pigment Red 31, C.I. Pigment Red 146, C.I. Pigment Red 147, C.I. Pigment Red 150, C.I. Pigment Red 184 and C.I. Pigment Red 269 (each according to what is named in Color Index, Fourth Edition).

23. The image forming method according to claim 11, wherein said colorant is a yellow colorant, and is a compound selected from the group consisting of C.I. Pigment Yellow 17, C.I. Pigment Yellow 74, C.I. Pigment Yellow 93, C.I. Pigment Yellow 155 and C.I. Pigment Yellow 180 (each according to what is named in Color Index, Fourth Edition).

24. The image forming method according to claim 11, wherein said colorant is a cyan colorant, and is a compound selected from the group consisting of C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66 (each according to what is named in Color Index, Fourth Edition).

25. The image forming method according to claim 11, wherein said colorant is a black colorant, and is carbon black or a magnetic material.

* * * * *